US007575041B2

(12) United States Patent
Odashima et al.

(10) Patent No.: US 7,575,041 B2
(45) Date of Patent: Aug. 18, 2009

(54) HORIZONTALLY CONTINUOUSLY CAST ROD OF ALUMINUM ALLOY AND METHOD AND EQUIPMENT FOR PRODUCING THE ROD

(75) Inventors: Yasuhide Odashima, Kitakata (JP); Satoshi Fujii, Kitakata (JP); Shigeru Yanagimoto, Kitakata (JP)

(73) Assignee: Showda Denko K.K., Tokyo (JP)

( * ) Notice: Subject to any disclaimer, the term of this patent is extended or adjusted under 35 U.S.C. 154(b) by 515 days.

(21) Appl. No.: 10/550,270

(22) PCT Filed: Mar. 26, 2004

(86) PCT No.: PCT/JP2004/004289

§ 371 (c)(1),
(2), (4) Date: Jul. 6, 2006

(87) PCT Pub. No.: WO2004/085096

PCT Pub. Date: Oct. 7, 2004

(65) Prior Publication Data

US 2006/0254679 A1 Nov. 16, 2006

Related U.S. Application Data

(60) Provisional application No. 60/459,617, filed on Apr. 3, 2003, provisional application No. 60/460,823, filed on Apr. 8, 2003.

(30) Foreign Application Priority Data

Mar. 26, 2003 (JP) ..... 2003-086506
Mar. 31, 2003 (JP) ..... 2003-095544

(51) Int. Cl.

| | |
|---|---|
| ***B22D 11/10*** | (2006.01) |
| ***B22D 11/12*** | (2006.01) |
| ***B22D 11/126*** | (2006.01) |
| ***B22D 11/16*** | (2006.01) |
| ***C22F 1/04*** | (2006.01) |

(52) U.S. Cl. ..... 164/490; 164/452; 164/460; 164/476; 164/477; 164/440; 148/551

(58) Field of Classification Search ..... 164/490, 164/440, 451, 452, 454, 460, 476, 477, 413, 164/417, 447; 148/551
See application file for complete search history.

(56) References Cited

U.S. PATENT DOCUMENTS 4,545,227 A 10/1985 Sudoh et al.

(Continued)

FOREIGN PATENT DOCUMENTS

EP 0577232 A1 1/1994

(Continued)

OTHER PUBLICATIONS

Yoh, "HDC Process for Small Diameter Ingot," Light Metals, United States of America, The Mineral, Metals & Materials Society, 673-679 (1989).

(Continued)

*Primary Examiner*—Kevin P Kerns
(74) *Attorney, Agent, or Firm*—Sughrue Mion, PLLC

(57) ABSTRACT

Horizontally continuously cast aluminum alloy rods excellent in quality are efficiently manufactured using a melting/holding furnace (101) to produce molten aluminum alloy, a molten-metal treatment apparatus (201) to remove aluminum oxide and hydrogen gas from the molten aluminum alloy, a horizontally continuously casting apparatus (301) to cast the treated molten aluminum alloy into horizontally continuously cast aluminum alloy rods, a cutting machine (408A, 408B) to cut to a standard length the cast rods, a first straightening apparatus (1001) to straighten bend of the cut rods, a peeling apparatus (1101) to peel skin portions of the straightened rods, a nondestructive inspection apparatus (1401) to inspect surface and internal portions of the peeled rods, a sorting apparatus (1501) to sort the inspected rods judged non-defective based on results of the nondestructive inspection step and a packing apparatus to pack the sorted rods, and continuously using at least the first straightening apparatus (1001) et seq.

18 Claims, 21 Drawing Sheets

U.S. PATENT DOCUMENTS

| | | | | |
|---|---|---|---|---|
| 4,653,571 | A * | 3/1987 | Suzuki et al. | 164/490 |
| 5,358,028 | A | 10/1994 | Keutgen et al. | |
| 2003/0026726 | A1 | 2/2003 | Sato et al. | |

FOREIGN PATENT DOCUMENTS

| | | | |
|---|---|---|---|
| JP | 58-100016 | A | 6/1983 |
| JP | 58-221611 | B2 | 12/1983 |
| JP | 59-193238 | A | 11/1984 |
| JP | 62-89551 | A | 4/1987 |
| JP | 62-286623 | A | 12/1987 |
| JP | 63-104751 | A | 5/1988 |
| JP | 64-39339 | A | 2/1989 |
| JP | 01-092039 | A | 4/1989 |
| JP | 1-104741 | A | 4/1989 |
| JP | 01-147039 | A | 6/1989 |
| JP | 02-192860 | A | 7/1990 |
| JP | 04-006449 | B2 | 2/1992 |
| JP | 04-190947 | A | 7/1992 |
| JP | 07-040017 | A | 2/1995 |
| JP | 07-311179 | A | 11/1995 |
| JP | 9-30773 | A | 2/1997 |
| JP | 11-254093 | A | 9/1999 |
| JP | 2003-019533 | A | 1/2003 |
| JP | 2003-027171 | A | 1/2003 |

OTHER PUBLICATIONS

Takimizu, et al., "Hot rotary-type vortex deep flaw of bar material," Iron and Steel, Japan, Japan Steel Institute 69(13):45 (Sep. 3, 1983), Resume (II) <Possessing Material> of Lecture No. 106 of the Japan Steel Institute.

Shinjo, et al., "Development of high speed continuous horizontal casting method and making the method practical," Altopia published by Karosu Publishing Company 20(10):9-15 (Oct. 15, 1990).

"Ultrasonic Technology Handbook", The Nikkan Kogyo Shimbun, Ltd., Dec. 30, 1985, pp. 721-737.

* cited by examiner (a)

(b)

(a)

(b)

HORIZONTALLY CONTINUOUSLY CAST ROD OF ALUMINUM ALLOY AND METHOD AND EQUIPMENT FOR PRODUCING THE ROD

CROSS REFERENCE TO RELATED APPLICATIONS

This application is an application filed under 35 U.S.C. §111(a) claiming the benefit pursuant to 35 U.S.C. §119(e)(1) of the filing date of Provisional Applications No. 60/459,617 FILED Apr. 3, 2003 and No. 60/460,823 filed Apr. 8, 2003 pursuant to 35 U.S.C. §111(b).

TECHNICAL FIELD

The present invention relates to horizontally continuously cast aluminum alloy rods and a method and equipment for manufacturing the rods.

BACKGROUND ART

Generally, horizontally continuously cast aluminum alloy rods are manufactured through casting. Specifically, molten aluminum alloy is cast into elongated ingots assuming the form of a circular pillar, a square pillar or a hollow pillar. The manufacturing method will be described below.

First, raw material for aluminum alloy is charged into a melting/holding furnace to produce molten aluminum alloy. Then, aluminum oxide and hydrogen gas are removed from the molten aluminum alloy by use of a molten-metal treatment apparatus. Subsequently, the treated molten aluminum alloy is supplied to a horizontally continuously casting apparatus to thereby manufacture horizontally continuously cast aluminum alloy rods. Next, the horizontally continuously cast aluminum alloy rods are cut to a predetermined length and subjected to subsequent processes (machining and heat treatment). Refer to, for example, JP-A SHO 63-104751 and JP-A SHO 62-89551.

Notably, molten aluminum alloy is transferred from the melting/holding furnace to the molten-metal treatment apparatus by use of a ladling apparatus having a ladle or by use of a heat-resistant chute.

Cut, horizontally continuously cast, aluminum alloy rods are bundled and then transferred by use of a crane or forklift.

However, an as-cast ingot (continuously cast aluminum alloy rod) has a heterogeneous microstructure, typified by an inverse segregation layer, formed in a surface thereof. Since such a heterogeneous microstructure causes cracking or the like in the course of plastic working that uses a continuously cast aluminum alloy rod as raw material, a production process for producing continuously cast aluminum alloy rods needs to include a peeling process for removing a portion of heterogeneous microstructure through cutting.

Thus, conventionally, obtained continuously cast aluminum alloy rods are fed to a peeling apparatus for removing their respective casting surface portions (also called "skin").

Furthermore, the continuously cast aluminum alloy rods that have undergone removal of their respective casting surface portions (skin portions) are subjected to quality inspection in a nondestructive inspection process, which combines surface inspection performed by an operator's visual inspection or by use of eddy current, and internal inspection performed by use of ultrasonic waves or X-rays (refer to, for example, "Ultrasonic Technology Handbook," The Nikkan Kogyo Shimbun, Ltd., 30 Dec. 1985, pp. 721-737).

Conventionally, in the manufacture of horizontally continuously cast aluminum alloy rods, the above-mentioned processes have been performed in a batch-like fashion. The manufacture involves periodic supply of raw material, bundling for conveyance and release from a bundled condition, for example. As a result, horizontally continuously cast aluminum alloy rods cannot be manufactured efficiently over a long period of time.

Implementation of a through, continuous process must solve the problems on how aluminum alloy is supplied continuously over a long period of time in a consistent manner and how horizontally continuously cast aluminum alloy rods are conveyed smoothly between processes.

Therefore, mere interconnection of apparatus has encountered difficulty in implementing a through, continuous process.

However, conventionally, since continuously cast aluminum alloy rods have not been continuously fed to a peeling apparatus, the peeling process has encountered difficulty in removing casting surface portions with high productivity.

Since production processes and an inspection process undergo their separate batch processes, cooperation between adjacent processes is insufficient, and feedback of inspection results to the production processes involves a time lag. As a result, continuous production of continuously cast aluminum alloy rods of consistent quality has failed to attain.

In view of the foregoing, an object of the present invention is to provide a method and equipment for manufacturing horizontally continuously cast aluminum alloy rods capable of continuously manufacturing horizontally continuously cast aluminum alloy rods efficiently over a long period of time, as well as horizontally continuously cast aluminum alloy rods manufactured by the method or equipment.

DISCLOSURE OF THE INVENTION

The present invention provides a method for manufacturing horizontally continuously cast aluminum alloy rods, comprising: a melting step of melting raw material for aluminum alloy to produce molten aluminum alloy; a molten-metal treatment step of removing aluminum oxide and hydrogen gas from the molten aluminum alloy received from the melting step; a horizontally continuously casting step of casting the molten aluminum alloy received from the molten-metal treatment step into horizontally continuously cast aluminum alloy rods; a cutting step of cutting to a standard length the horizontally continuously cast aluminum alloy rods cast in the horizontally continuously casting step; a conveying step of conveying the cut, horizontally continuously cast aluminum alloy rods; a first straightening step of straightening bend of the conveyed, horizontally continuously cast aluminum alloy rods; a peeling step of peeling skin portions of the straightened, horizontally continuously cast aluminum alloy rods; a nondestructive inspection step of inspecting surface and internal portions of the horizontally continuously cast aluminum alloy rods having the casting surface portions peeled; a sorting step of sorting horizontally continuously cast aluminum alloy rods judged non-defective based on results of the nondestructive inspection step; and a packing step of packing the horizontally continuously cast aluminum alloy rods judged non-defective, with all steps being continuously performed.

In the method, an average temperature drop rate of the molten aluminum alloy is set to 15% or lower as measured between the melting step and the horizontally continuously casting step.

In any one of the methods, in the melting step, tapping from a melting/holding furnace to the molten-metal treatment step is performed by a drop tapping method in which a surface of molten metal to be tapped is higher in level than a surface of tapped molten metal, or by a level-feed tapping method in which the surface of molten metal to be tapped is continuously connected to the surface of tapped molten metal.

In any one of the methods, the melting step uses a plurality of melting/holding furnaces arranged in parallel in association with the molten-metal treatment step.

In any one of the methods, in the cutting step, at least one casting line in the horizontally continuously casting step is capable of being restarted.

The first mentioned method further comprises a heat treatment step of heat-treating the horizontally continuously cast aluminum alloy rods between the cutting step and the nondestructive inspection step.

The first mentioned method further comprises, between the conveying step and the first straightening step, an arraying step of arraying the horizontally continuously cast aluminum alloy rods by a conveyance method that combines conveyance of the rods in a lateral direction and conveyance of the rods in a longitudinal direction.

In the first mentioned method, the nondestructive inspection step comprises a first nondestructive inspection step for surface inspection to control cutting conditions of the peeling step based on results of the first nondestructive inspection step and a second nondestructive inspection step for internal inspection to control casting conditions of the continuously casting step based on results of the second nondestructive inspection step.

In the method just mentioned, the first nondestructive inspection step is performed by at least one method selected from among an eddy-current inspection method for detecting a surface defect of a horizontally continuously cast aluminum alloy rod by use of eddy current, an image-processing inspection method for detecting a surface defect of a horizontally continuously cast aluminum alloy rod and a visual inspection method for visually detecting a surface defect of a horizontally continuously cast aluminum alloy rod, and the second nondestructive inspection step is performed by at least one method selected from among an X-ray inspection method for detecting an internal defect of a horizontally continuously cast aluminum alloy rod by use of X-rays and an ultrasonic inspection method for detecting an internal defect of a horizontally continuously cast aluminum alloy rod by use of ultrasonic waves.

In the eighth mentioned method, the nondestructive inspection step combines internal inspection and surface inspection, the internal inspection is performed by at least one method selected from an X-ray inspection method for detecting an internal defect of a horizontally continuously cast aluminum alloy rod by use of X-rays and an ultrasonic inspection method for detecting an internal defect of a horizontally continuously cast aluminum alloy rod by use of ultrasonic waves, and the surface inspection is performed by at least one method selected from among an eddy-current inspection method for detecting a surface defect of a horizontally continuously cast aluminum alloy rod by use of eddy current, an image-processing inspection method for detecting a surface defect of a horizontally continuously cast aluminum alloy rod by means of processing an image of a surface of the horizontally continuously cast aluminum alloy rod, and a visual inspection method for visually detecting a surface defect of a horizontally continuously cast aluminum alloy rod.

The first mentioned method, wherein the nondestructive inspection step comprises a first nondestructive inspection step for inspecting surface portions of horizontally continuously cast aluminum alloy rods and a second nondestructive inspection step for inspecting internal portions of the rods, in which the first nondestructive inspection step comprises an encircling eddy-current flaw detection step to pass the rods through a probe and a rotary eddy-current flaw detection step to rotate the probe in a longitudinal direction of the rods, further comprises a control step that comprises comparing a number of defects detected at the encircling eddy-current flaw detection step and the rotary eddy-current flaw detection step with a detection number judgment standard to obtain defect distribution groups, comparing the number of defects in each of the defect distribution group with a group judgment standard to obtain groups exceeding the group judgment standard and controlling, based on the groups exceeding the group judgment standard, molten-metal treatment conditions at the molten-metal treatment step, casting conditions at the horizontally continuously casting step and cutting conditions at the cutting step.

The first mentioned method, wherein the nondestructive inspection step comprises a first nondestructive inspection step for inspecting surface portions of horizontally continuously cast aluminum alloy rods and a second nondestructive inspection step for inspecting internal portions of the rods, in which the first nondestructive inspection step comprises an encircling eddy-current flaw detection step to pass the rods through a probe and a rotary eddy-current flaw detection step to rotate the probe in a longitudinal direction of the rods, further comprises a control step comparing a number of defects detected at the encircling eddy-current flaw detection step and the rotary eddy-current flaw detection step with a detection number judgment standard to obtain defect distribution groups, comparing the number of defects in each of the defect distribution group with a group judgment standard to obtain groups exceeding the group judgment standard and controlling, based on the groups exceeding the group judgment standard, straightening conditions at the first straightening step.

The sixth mentioned method further comprises a binding step of binding the horizontally continuously cast aluminum alloy rods before the heat treatment step and an unbinding step of unbinding the bound rods after the heat treatment step.

The first mentioned method further comprises a binding step of binding the horizontally continuously cast aluminum alloy rods before the heat treatment step.

In the method just mentioned, the horizontally continuously cast aluminum alloy rods are stacked while supporting only opposite end portions of the rods.

In the first mentioned method, the conveying step has a retention function for temporarily retaining the horizontally continuously cast aluminum alloy rods.

In the method just mentioned, the retention function is such that the horizontally continuously cast aluminum alloy rods are conveyed laterally.

In the first mentioned and sixteenth mentioned methods, the conveying step uses a slat conveyor.

Equipment for manufacturing horizontally continuously cast aluminum alloy rods, used in any one of the methods.

A horizontally continuously cast aluminum alloy rod manufactured by any one of the methods or the equipment just mentioned.

The horizontally continuously cast aluminum alloy rod manufactured has a diameter of 20 mm to 100 mm.

The horizontally continuously cast aluminum alloy rod manufactured has a Si content of 7% to 14% by mass, an iron content of 0.1% to 0.5% by mass, a copper content of 1% to 9% by mass, a Mn content of 0% to 0.5% by mass and a Mg content of 0.1% to 1% by mass.

According to the method or equipment for manufacturing horizontally continuously cast aluminum alloy rods, contemplated by the present invention, it is possible to efficiently manufacture horizontally continuously cast aluminum alloy rods that has casting surface portions removed efficiently from them and are excellent and consistent in quality.

The horizontally continuously cast aluminum alloy rods of the present invention are excellent in mechanical properties and are enhanced in friction resistance.

MODES FOR CARRYING OUT THE INVENTION

Embodiments of the present invention will next be described in detail.

Figure 1:
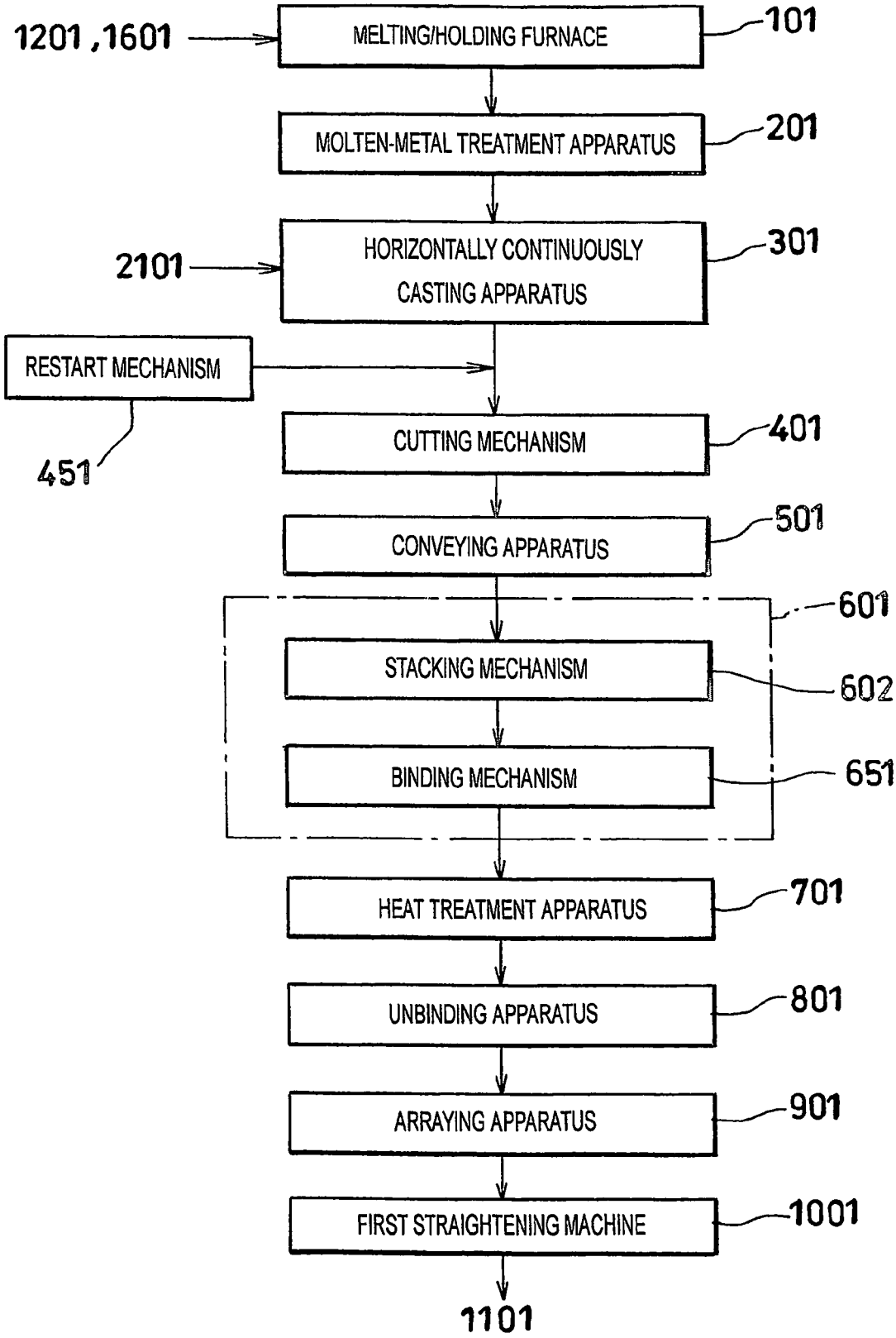
FIG. 1 is part of a flowchart that specifies equipment for manufacturing horizontally continuously cast aluminum alloy rods according to an embodiment of the present invention.
Figure 2:
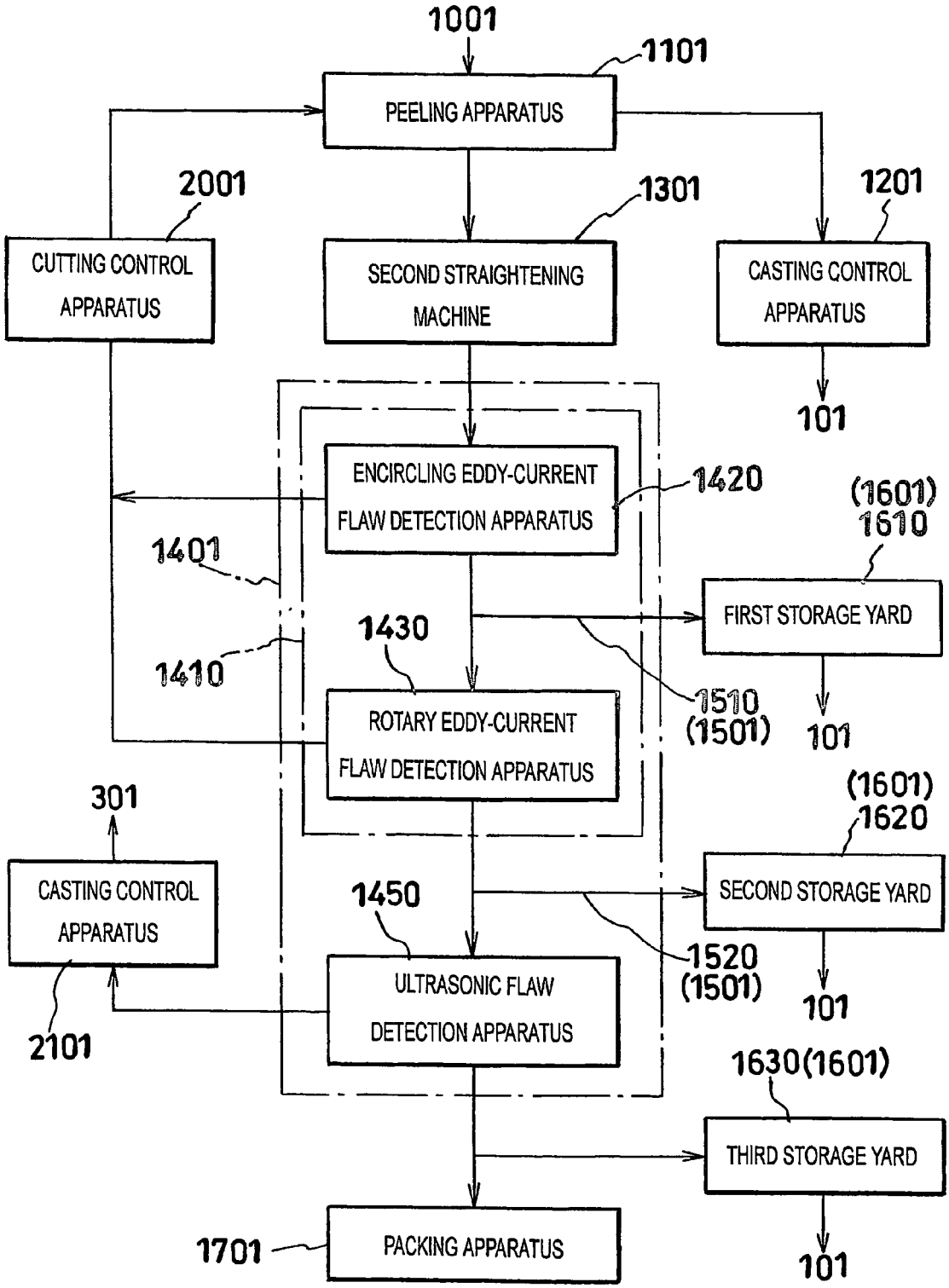
FIG. 2 is the remainder of the flowchart specifying the equipment for manufacturing horizontally continuously cast aluminum alloy rods according to the embodiment of the present invention.

FIG. 1 and FIG. 2 show a flowchart that specifies equipment for manufacturing horizontally continuously cast aluminum alloy rods according to an embodiment of the present invention. In FIG. 1 and FIG. 2, reference numeral 101 denotes a melting/holding furnace (melting step) that melts raw material for aluminum alloy so as to produce molten aluminum alloy. Reference numeral 201 denotes a molten-metal treatment apparatus (molten-metal treatment step) that removes aluminum oxide and hydrogen gas from the molten aluminum alloy received from the melting/holding furnace 101. Reference numeral 301 denotes a horizontally continuously casting apparatus (horizontally continuously casting step) that casts the molten aluminum alloy received from the molten-metal treatment apparatus 201 into horizontally continuously cast aluminum alloy rods.

Reference numeral 401 denotes a cutting mechanism that partially constitutes a cutting apparatus (cutting step) and cuts to a standard length the horizontally continuously cast aluminum alloy rods cast by the horizontally continuously casting apparatus 301. Reference numeral 451 denotes a restart mechanism that partially constitutes the cutting apparatus (cutting step) and restarts one or more casting lines of the horizontally continuously casting apparatus 301, which have stopped casting due to occurrence of a problem, without influencing other casting lines. Reference numeral 501 denotes a conveying apparatus (conveying step) that conveys the horizontally continuously cast aluminum alloy rods, which have undergone cutting by the cutting mechanism 401, to a binding apparatus 601 of the next step. Reference numeral 601 denotes a binding apparatus (binding step) that includes a stacking mechanism 602 and a binding mechanism 651. The stacking mechanism 602 stacks, in a predetermined form, a predetermined number of the horizontally continuously cast aluminum alloy rods that have been conveyed thereto from the conveying apparatus 501. The binding mechanism 651 binds the horizontally continuously cast aluminum alloy rods that are stacked by the stacking mechanism 602 and sends them to a heat treatment apparatus 701 of the next step.

The heat treatment apparatus (heat treatment step) 701 heat-treats the horizontally continuously cast aluminum alloy rods that are bound in a bundle and conveyed thereto from the binding apparatus 601 in order to homogenize the casting microstructure thereof and to adjust the hardness thereof. Reference numeral 801 denotes an unbinding apparatus (unbinding step) that unbinds the horizontally continuously cast aluminum alloy rods, which are bound in a bundle and conveyed thereto from the heat treatment apparatus 701, so as to allow individual handling of the horizontally continuously cast aluminum alloy rods. Reference numeral 901 denotes an arraying apparatus (arraying step) that arrays the horizontally continuously cast aluminum alloy rods, which have been unbound by the unbinding apparatus 801, in a row in their longitudinal direction. Reference numeral 1001 denotes a first straightening machine (straightening step) that straightens any bend in a horizontally continuously cast aluminum alloy rod, which has been conveyed thereto from the arraying apparatus 901, in order to obtain a horizontally continuously cast aluminum alloy rod having a predetermined diameter by removing in the next step a skin portion (a casting surface portion also called "skin"), from the thus straightened horizontally continuously cast aluminum alloy rod by means of a peeling apparatus 1101.

The peeling apparatus (peeling step) 1101 removes the skin portion from the horizontally continuously cast aluminum alloy rod in which bends have been straightened by the first straightening machine 1001. Reference numeral 1201 denotes a chip-breaking machine (chip-breaking step) that continuously breaks chips, which have been produced in the process of removing a skin portion from a continuously cast aluminum-alloy rod by the peeling apparatus 1101, before the chips are returned to the melting/holding furnace 101. Reference numeral 1301 denotes a second straightening machine (straightening step) that straightens any bend in the horizontally continuously cast aluminum alloy rod, the skin portion of which has been removed by the peeling apparatus 1101, in order to allow a nondestructive inspection apparatus 1401 of the next step to accurately inspect the interior of the peeled horizontally continuously cast aluminum alloy rod.

The nondestructive inspection apparatus (nondestructive inspection step) 1401 inspects, for an unacceptable defect, the horizontally continuously cast aluminum alloy rod having the bends straightened by the second straightening machine 1301. It includes a first nondestructive inspection apparatus (first nondestructive inspection step) 1410 for inspecting the continuously cast aluminum alloy rod for defects in a surface portion thereof and an ultrasonic flaw detection apparatus 1450 serving as a second nondestructive inspection apparatus (second nondestructive inspection step) for inspecting the continuously cast aluminum alloy rod for defects in an internal portion thereof. The first nondestructive inspection apparatus (first nondestructive inspection step) 1410 includes an encircling eddy-current flaw detection apparatus 1420 and a rotary eddy-current flaw detection apparatus 1430.

Reference numeral 1501 denotes a sorting apparatus (sorting step) that includes a first sorting apparatus (first sorting step) 1510 for sending to the rotary eddy-current flaw detection apparatus 1430 of the next step a continuously cast aluminum alloy rod that has been judged non-defective in inspection by the encircling eddy-current flaw detection apparatus 1420 and for sending to a first storage yard 1610 a continuously cast aluminum alloy rod that has been judged defective in inspection by the encircling eddy-current flaw detection apparatus 1420, a second sorting apparatus (second sorting step) 1520 for sending to the ultrasonic flaw detection apparatus 1450 of the next step a continuously cast aluminum alloy rod that has been judged non-defective in inspection by the rotary eddy-current flaw detection apparatus 1430 and for sending to a second storage yard 1620 a continuously cast aluminum alloy rod that has been judged defective in inspection by the rotary eddy-current flaw detection apparatus 1430 and a third sorting apparatus (third sorting step) 1530 for sending to the packing apparatus 1701 of the next step a continuously cast aluminum alloy rod that has been judged non-defective in inspection by the ultrasonic flaw detection apparatus 1450 and for sending to a third storage yard 1630 a continuously cast aluminum alloy rod that has been judged defective in inspection by the ultrasonic flaw detection apparatus 1450.

Reference numeral 1601 denotes a storage yard (storing step) that includes the first storage yard 1610 for storing continuously cast aluminum alloy rods that have been judged defective and received from the first sorting apparatus 1510, the second storage yard 1620 for storing continuously cast aluminum alloy rods that have been judged defective and received from the second sorting apparatus 1520 and the third storage yard 1630 for storing continuously cast aluminum alloy rods that have been judged defective and received from the third sorting apparatus 1530. The storage yard 1601 stores the continuously cast aluminum alloy rods that are, for example, to be returned to the melting/heating furnace 101 after being broken. The packing apparatus (packing step) 1701 packs, in a predetermined form, a predetermined number of the continuously cast aluminum alloy rods that have undergone heat treatment and removal of respective skin portions and have been judged non-defective in the nondestructive inspection.

Reference numeral 2001 denotes a cutting control apparatus that controls cutting conditions of the peeling apparatus 1101 on the basis of inspection results of the encircling eddy-current flaw detection apparatus 1420 and the rotary eddy-current flaw detection apparatus 1430 in the first nondestructive inspection apparatus 1410. Reference numeral 2101 denotes a casting control apparatus that controls casting conditions of the continuous casting apparatus 301 on the basis of inspection results of the ultrasonic flaw detection apparatus 1450 serving as the second nondestructive inspection apparatus.

Figure 3:
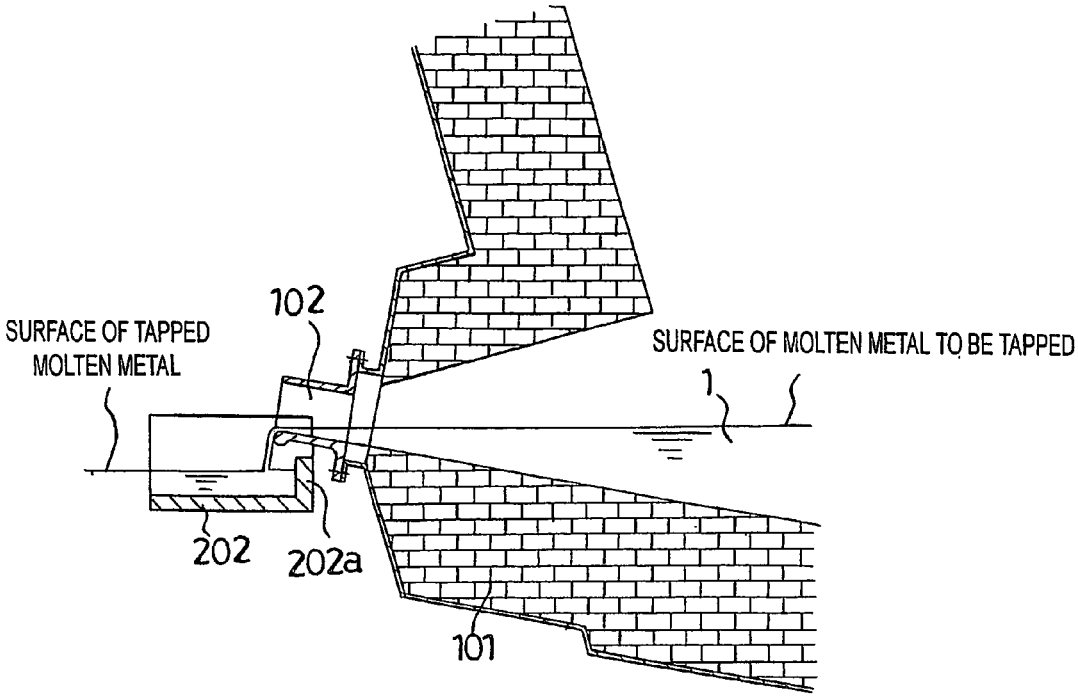
FIG. 3 is an explanatory view showing an example of a melting/holding furnace.
Figure 4:
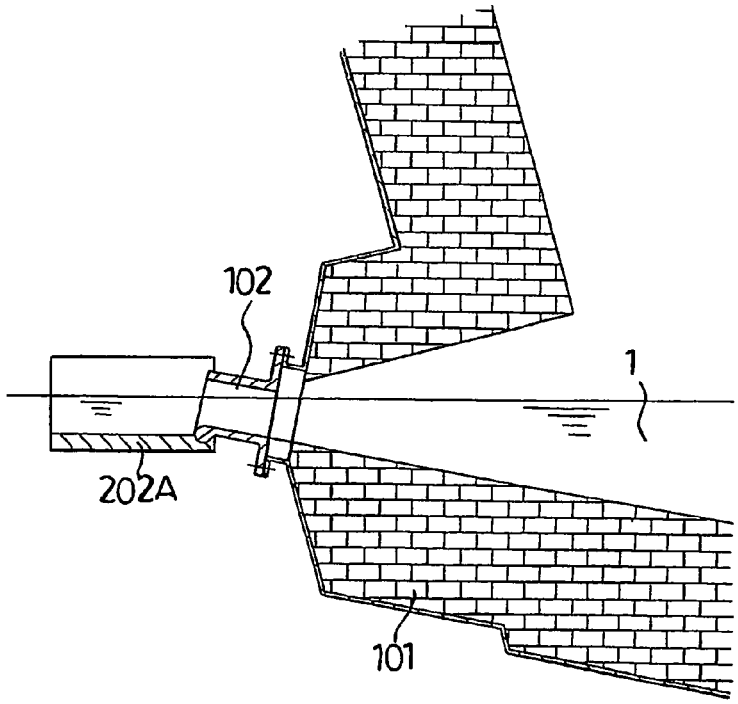
FIG. 4 is an explanatory view showing another example of a melting/holding furnace.

FIG. 3 and FIG. 4 are explanatory views showing examples of the melting/holding furnace 101. FIG. 3 and FIG. 4 are vertically sectional views. In FIG. 3 and FIG. 4, reference numeral 101 denotes a melting/holding furnace that is rotated about a support shaft (not shown) to thereby tap molten aluminum alloy 1 to a chute 202 or 202A of the molten-metal treatment apparatus 201 through a tap hole 102. The melting/holding furnace 101 shown in FIG. 3 employs a drop tapping method (mechanism) in which molten alloy is tapped to the molten-metal treatment apparatus 201 (to the chute 202 having an overflow preventive wall 202*a*) such that the surface of molten alloy to be tapped is higher in level than the surface of tapped molten alloy in the molten-metal treatment apparatus 201 (chute 202). The melting/holding furnace 101 shown in FIG. 4 employs a level-feed tapping method (mechanism) in which molten metal is tapped to the molten-metal treatment apparatus 201 (to the chute 202A) such that the surface of molten alloy to be tapped is continuously connected to the surface of tapped molten alloy in the molten-metal treatment apparatus 201 (chute 202A).

Figure 5:
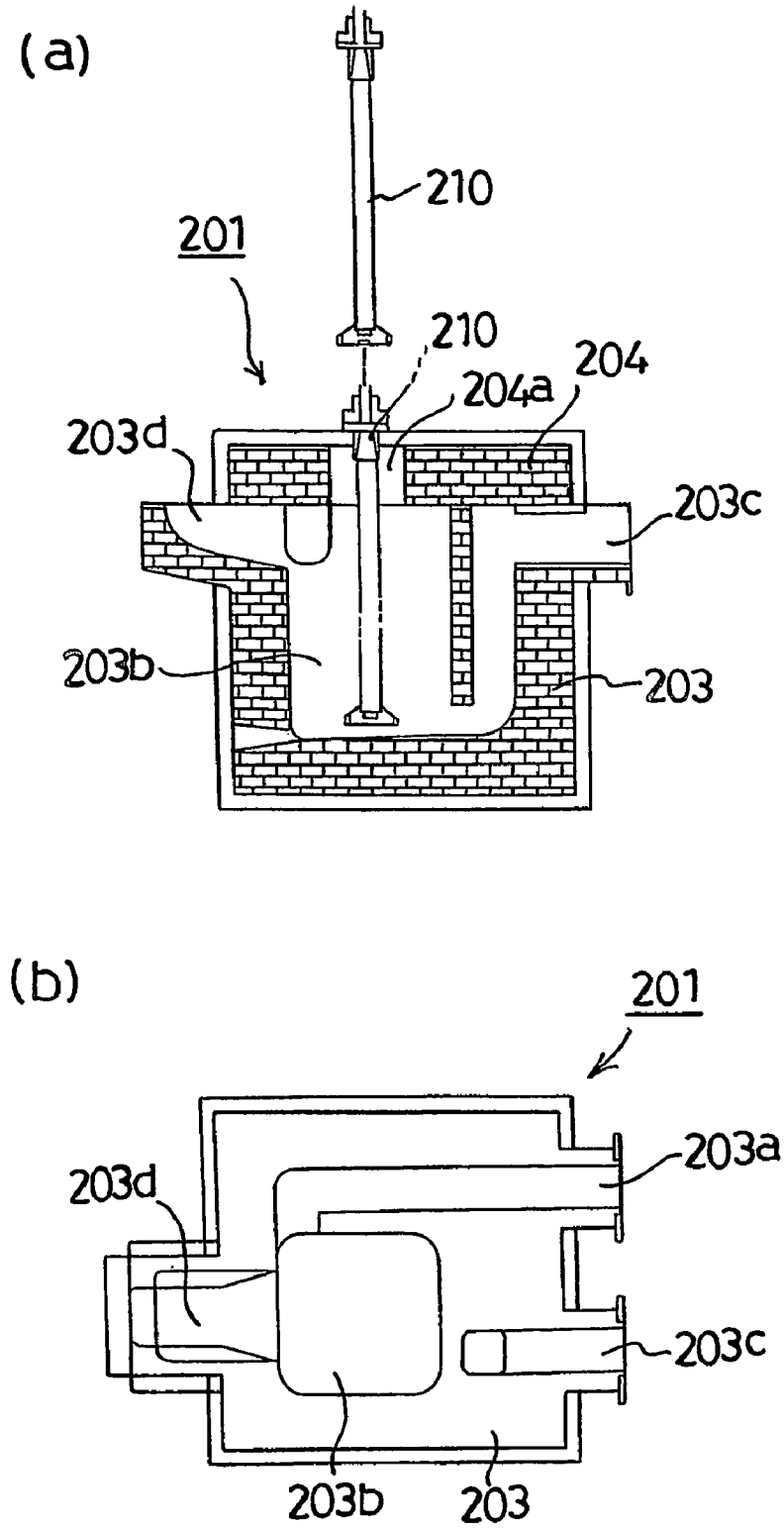
FIG. 5 is an explanatory view showing an example of a molten-metal treatment apparatus, FIG. 5(*a*) depicting a longitudinal section thereof and FIG. 5(*b*) a plan view of a reservoir, with a cover removed.

FIG. 5(*a*) and FIG. 5(*b*) are explanatory views showing an example of the molten-metal treatment apparatus 201. FIG. 5(*a*) is a vertically sectional view and FIG. 5(*b*) is a plan view of an uncovered reservoir. In FIG. 5, the molten-metal treatment apparatus 201 includes a reservoir 203 and a cover 204 for covering the reservoir 203. The reservoir 203 retains in a reservoir portion 203*b* molten aluminum alloy 1 fed to a molten alloy inlet 203*a* from the chute 202 or 202A and allows the treated molten aluminum alloy 1 to be tapped from the reservoir portion 203*b* to the horizontally continuously casting apparatus 301 through a tap hole 203*c*. As shown in FIG. 5(*a*), the reservoir 203 has a slag-removing opening 203*d* from which slag surfacing when the molten aluminum alloy 1 has been treated while the cover 204 is on is removed. The cover 204 has an opening 204*a*. While the reservoir 203 is covered with the cover 204, a stirring member 210 is inserted into or drawn out from the reservoir 203 through the opening 204*a*. The stirring member 210 rotationally stirs the molten aluminum alloy 1 in the reservoir 203 while discharging process gas (inert gas, such as argon gas) from the bottom portion of the reservoir 203.

In the present invention, while a certain melting/holding furnace 101 is in the process of feeding the molten aluminum alloy 1, raw material for aluminum alloy is charged into another melting/holding furnace 101, and required adjustment of composition and temperature is carried out in order to prepare for the next feed of the molten aluminum alloy 1. When the amount of the molten aluminum alloy 1 contained in the melting/holding furnace 101 that is currently in the process of feeding the molten aluminum alloy 1 drops to a predetermined level or less, the currently active melting/holding furnace 101 is changed over to another melting/holding furnace 101 that is ready for feeding. Alternate operation of the melting/holding furnaces 101 enables continuous feed of the molten aluminum alloy 1 to the molten-metal treatment apparatus 201, thereby enabling continuous casting of continuously cast aluminum alloy rods of the same kind. An important point is that, at the time of operation changeover, discontinuance does not arise in terms of feed of the molten aluminum alloy 1 to the continuously casting apparatus 301.

As shown in FIG. 3, the present invention can perform tapping control by a drop tapping method in which the tap hole 102 of the melting/holding furnace 101 is located higher than the surface of tapped molten alloy in the chute 202, and the melting/holding furnace 101 is tilted to feed the molten aluminum alloy 1 into the chute 202. At this time, the molten aluminum alloy 1 fed into the chute 202 is disturbed and comes into contact with the air, whereby aluminum oxide is generated. However, the aluminum oxide can be removed in the molten-metal treatment apparatus 201. Notably, upon completion of feed of the molten aluminum alloy 1, the tilted melting/holding furnace 101 is returned to its original position. In the process of feeding the molten aluminum alloy 1, the surface of the molten aluminum alloy 1 in the chute 202 is disconnected from the surface of molten alloy in the melting/holding furnace 101.

Therefore, the tilted condition of the melting/holding furnace 101 is irrelevant to the level of the molten aluminum alloy 1 in the chute 202. In the case of alternate operation of the melting/holding furnaces 101, at the time of operation changeover, a plurality of melting/holding furnaces 101 may be connected to the chute 202 in relation to tapping. However, in the drop tapping method, since the level of the molten aluminum alloy 1 in the chute 202 is disconnected from the level of the molten aluminum alloy 1 in the melting/holding furnace 101, without considering the level of the molten aluminum alloy 1 in the chute 202, the melting/holding furnace 101 that has completed feed of the molten aluminum alloy 1 can be returned to its original position, and the next melting/holding furnace 101 can be tilted.

As a result, fluctuations in the level of molten alloy, which would otherwise result at the time of changing over the melting/holding furnaces 101, can be suppressed. Since fluctuations in the level of molten alloy are thus suppressed, occurrence of discontinuance can be suppressed in terms of feed of the molten aluminum alloy 1 to the horizontally continuously casting apparatus 301. Through employment of the drop tapping method, at the time of ending feed, the melting/holding furnace 101 can be tilted to a great extent so as to reduce the amount of the molten aluminum alloy 1 remaining therein, thereby enhancing efficiency. Employment of the drop tapping method can prevent overflow or leakage of the molten aluminum alloy 1 to the exterior of the molten-metal treatment apparatus 201 (beyond the overflow preventive wall 202*a*) without use of a special leakage mechanism (member) or overflow preventive mechanism (member).

Next, the level-feed tapping method (tapping control) shown in FIG. 4 is such that the surface (level) of the molten aluminum alloy 1 in the melting/holding furnace 101 is continuously connected to the surface (level) of tapped molten metal in the chute 202A. Thus, at the time of changing over the melting/holding furnaces 101, an associated tilting motion may raise fluctuations in the level of molten metal. However, since the molten aluminum alloy 1 that is being fed to the chute 202A is not disturbed, aluminum oxide is generated in a smaller amount as compared with the drop tapping method.

A tapping control method is selected in view of the number of melting/holding furnaces 101, work performance associated with changeover of the melting/holding furnaces 101 and the treatment capability of the molten-metal treatment apparatus 201. Preferably, a monitoring camera and a monitor are provided in order to monitor the condition of the respective tap holes 102 of a plurality of melting/holding furnaces 101, and the operation of feeding the molten aluminum alloy 1 is performed while the feed is being monitored.

The molten-metal treatment apparatus 201 can be a conventional one (a molten-metal treatment apparatus whose reservoir does not have a slag-removing opening). However, since the molten aluminum alloy 1 is continuously fed over a long period of time, provision of the slag-removing opening 203*d* as shown in FIG. 5 is preferred. In the case of a conventional molten-metal treatment apparatus, when slag is to be removed, supply of argon gas used for molten-metal treatment is stopped, and then a cover is opened in order to remove slag. Thus, work efficiency is poor. However, since the molten-metal treatment apparatus 201 has the slag-removing opening 203*d*, slag can be removed without need to remove the cover 204. Thus, slag-removing work can be carried out safely.

Next, the tap hole 102 of the melting/holding furnace 101 is connected to the molten-metal inlet 203*a* of the molten-metal treatment apparatus 201 via the chute 202 or 202A. As needed, the tap hole 203*c* of the molten-metal treatment apparatus 201 is connected to a molten-metal inlet of the horizontally continuously casting apparatus 301 via a chute. An important point is to suppress temperature fluctuations of the molten aluminum alloy 1 to be fed to the molten-metal treatment apparatus 201 and to suppress temperature fluctuations of the molten aluminum alloy 1 to be fed to the horizontally continuously casting apparatus 301. Temperature fluctuations may incur insufficient molten-metal treatment and may complicate temperature control for the melting/holding furnace 101. However, suppression of temperature fluctuations associated with changeover of the melting/holding furnaces 101 enables suppression of temperature fluctuations of the molten aluminum alloy 1 to be fed to the molten-metal treatment apparatus 201 and to the horizontally continuously casting apparatus 301.

Preferably, temperature fluctuations of the molten aluminum alloy 1 are suppressed in the course of flow from the melting/holding furnaces 101 to the horizontally continuously casting apparatus 301 via the molten-metal treatment apparatus 201. For example, the drop rate of average temperature (° C.) is preferably suppressed to 15% or less (more preferably, 12% or less).

Attainment of such a drop rate can suppress temperature variations among molten aluminum alloys 1 to be fed to the horizontally continuously casting apparatus 301 from the corresponding melting/holding furnaces 101. Since a temperature drop is small, the temperature within the melting/holding furnaces 101 can be held low. That is, the temperature within the melting/holding furnaces 101 does not need to be held unnecessarily high. Thus, energy required for holding the temperature of the molten aluminum alloy 1 can be reduced. In the case of a certain aluminum alloy that needs to impart a high temperature to the molten aluminum alloy 1 for casting, the molten aluminum alloy 1 to be fed can be readily made to satisfy the temperature requirement.

Preferably, in order to reduce a temperature drop of the molten aluminum alloy 1 in the course of flow from the melting/holding furnaces 101 to the horizontally continuously casting apparatus 301, a thermal insulator is disposed on the outside of the chute 202 or 202A, and an openable cover is disposed on the chute 202 or 202A so as to prevent upward heat release from the chute 202 or 202A. Preferably, the chute 202 or 202A is arranged in such a manner as to shorten the distance between the molten-metal treatment apparatus 201 and a plurality of melting/holding furnaces 101 or such that substantially equal distances are established between the molten-metal treatment apparatus 201 and the plurality of melting/holding furnaces 101 or such that the distance does not incur temperature fluctuations, so as to suppress temperature variations among molten aluminum alloys 1 to be fed to the molten-metal treatment apparatus 201 from the plurality of corresponding melting/holding furnaces 101. Through such suppression of temperature variations, the melting/holding furnaces 101 share the same condition in terms of influence on their internal temperature. Thus, common temperature control conditions can be established among the melting/holding furnaces 101. As a result, temperature control is facilitated, and temperature fluctuations associated with changeover of the melting/holding furnaces 101 can be suppressed. Since temperature fluctuations are suppressed, occurrence of discontinuance can be suppressed in terms of feed of the molten aluminum alloy 1 to the horizontally continuously casting apparatus 301. Thus, continuously cast rods of consistent quality can be manufactured consistently.

Figure 6:
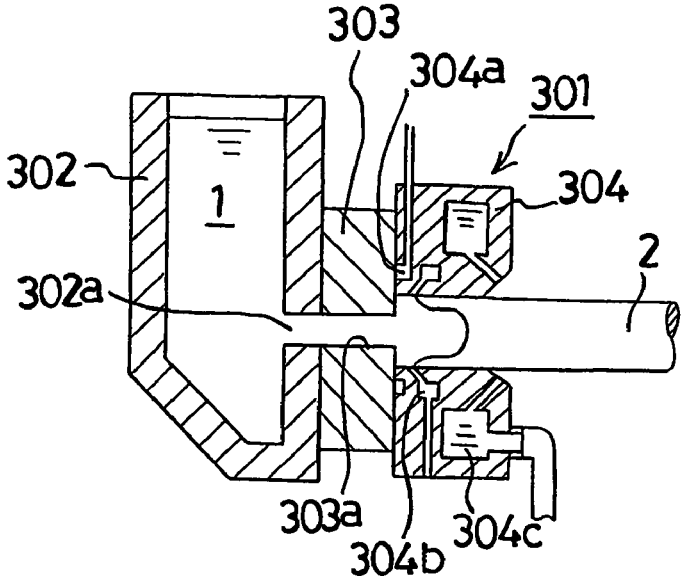
FIG. 6 is an explanatory view showing an example of a horizontally continuously casting apparatus.

FIG. 6 is an explanatory view showing an example of the horizontally continuously casting apparatus 301. FIG. 6 is a vertical sectional view. In FIG. 6, reference numeral 302 denotes a tundish for containing the molten aluminum alloy 1, and an opening 302*a* is formed in a side wall of the tundish 302. Reference numeral 303 denotes a refractory plate-like member that is attached to the outside of the tundish 302 in such a manner as to surround the opening 302*a*. A molten metal feeding hole 303*a* communicating with the opening 302*a* is formed in the refractory plate-like member 303. Reference numeral 304 denotes a tubular mold that is attached to the refractory plate-like member 303 such that its axis extends substantially horizontal. The mold 304 includes a gas feed path 304*a* for feeding gas to the circumferential interface between the mold 304 and the molten aluminum alloy 1 through the interface between the refractory plate-like member 303 and the mold 304, a lubricant feed path 304*b* for feeding lubricant to the circumferential interface between the mold 304 and a horizontally continuously cast aluminum alloy rod 2, and a cooling-water feed path 304*c* for feeding cooling water to the circumference of the horizontally continuously cast aluminum alloy rod 2 at the exit thereof.

While the refractory plate-like member 303 is sandwiched between the tundish 302 and the mold 304 that are connected together by means of a mechanical clamping mechanism, such as screws, springs or buckles, or by means of a power mechanism, such as an electric motor or an air cylinder. Such structure can reduce occurrence of casting halt that would otherwise result from leakage of molten metal and can readily implement long-term continuous operation. An air cylinder features simple structure, low installation cost, short attachment time and provision of consistent pressing force.

Next, casting of a horizontally continuously cast aluminum alloy rod 2 will be described. The molten aluminum alloy 1 that is fed into the tundish 302 from the molten-metal treatment apparatus 201 is fed, through the molten-metal feeding hole 303*a* of the refractory plate-like member 303, into the mold 304 whose axis is held substantially horizontal, and is forcibly cooled at the exit of the mold 304 to become the horizontally continuously cast aluminum alloy rod 2.

In order to monitor casting conditions of the horizontally continuously cast aluminum alloy rods 2, a monitor room is installed. A monitor camera is installed above the horizontal continuous casting apparatus 301, and the image of casting conditions captured by the monitor camera can be monitored in the monitor room. In the case of a large number of casting lines, the monitor camera enables monitoring of the casting conditions of all the casting lines. Particularly, when the casting surface of the horizontally continuously cast aluminum alloy rod 2 wrinkles intensively, casting becomes unstable, and continuous operation is disturbed. Thus, monitoring casting conditions allows preventive adjustment of operating conditions, thereby preventing occurrence of such a problem. Preferably, in order to prevent a disturbance of monitoring of casting surface caused by vapor generated during casting, an exhaust blower is installed in an observation area so as to allow close monitoring of the casting surface. In place of the horizontally continuously casting apparatus 301, a conventional horizontally continuously casting apparatus can be used.

The composition of the molten aluminum alloy 1 contained in the tundish 302 will next be described. Preferably, the molten aluminum alloy 1 contains Si in an amount of 7% to 14% by mass (more preferably 8% to 13% by mass, further preferably 12% to 13% by mass). Preferably, the molten aluminum alloy 1 further contains iron in an amount of 0.1% to 0.5% by mass, copper in an amount of 1.0% to 9.0% by mass, Mn in an amount of 0% to 0.5% by mass and Mg in an amount of 0.1% to 1.0% by mass. Particularly, a horizontally continuously cast aluminum alloy rod 2 that contains Si in an amount of 7% to 14% by mass is preferred for the following reason. Since aluminum and silicon contained in the horizontally continuously cast aluminum alloy rod 2 form a fine layer structure, excellent mechanical properties are provided, and hard silicon enhances wear resistance.

The percentage composition of the horizontally continuously cast aluminum alloy rod 2 in terms of alloy components can be confirmed by, for example, a photoelectric-photometry-type emission spectroscopic analyzer as described in JIS H 1305 (for example, PDA-5500, product of Shimazu Corporation).

Figure 7:
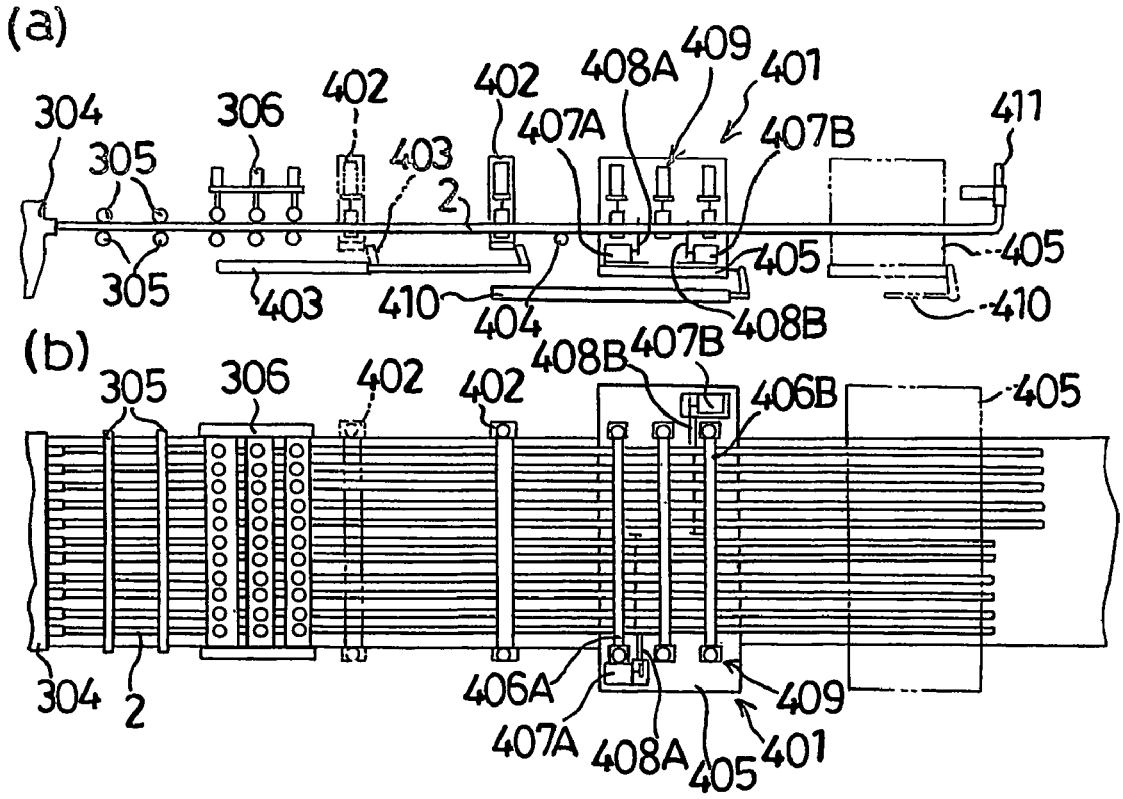
FIG. 7 is an explanatory view showing an example of a cutting mechanism, FIG. 7(*a*) depicting a side view thereof and FIG. 7(*b*) a plan view thereof.

FIG. 7(*a*) and FIG. 7(*b*) are explanatory views showing an example of the cutting mechanism 401. FIG. 7(*a*) is a side view, and FIG. 7(*b*) is a plan view. In FIG. 7, reference numeral 305 denotes a guide roller. The guide rollers 305 are provided in the vicinity of the exit of the mold 304 and support and guide rows of horizontally continuously cast aluminum alloy rods 2. Reference numeral 306 denotes a pinch-roller mechanism that is provided adjacent to and downstream (in the direction in which the horizontally continuously cast aluminum alloy rods 2 move; the same applies hereinafter) of the guide rollers 305, pinches rows of horizontally continuously cast aluminum alloy rods 2 between upper and lower rollers and is driven by a drive mechanism (not shown) so as to draw out and convey rows of horizontally continuously cast aluminum alloy rods 2 at the same speed as the casting speed of the molds 304.

Reference numeral 402 denotes a synchronous clamp mechanism that is provided adjacent to and downstream of the pinch roller mechanism 306 and press-clamps and releases rows of horizontally continuously cast aluminum alloy rods 2 by means of a hydraulic mechanism. Reference numeral 403 denotes a drive mechanism that is provided under the synchronous clamp mechanism 402 and is adapted to drive the synchronous clamp mechanism 402 upstream (opposite the direction in which the horizontally continuously cast aluminum alloy rods 2 move; the same applies hereinafter) along rows of horizontally continuously cast aluminum alloy rods 2 and to allow free movement of the synchronous clamp mechanism 402. Reference numeral 404 denotes a support roller that is provided downstream of the synchronous clamp mechanism 402 in such a position as not to obstruct the movement of the synchronous clamp mechanism 402 and supports rows of horizontally continuously cast aluminum alloy rods 2.

Reference numeral 405 denotes a movable base that is provided downstream of the support roller 404 and reciprocates along rows of horizontally continuously cast aluminum alloy rods 2. Reference numerals 406A and 406B denote rails that are provided on the movable base 405 and disposed perpendicular to rows of horizontally continuously cast aluminum alloy rods 2 while being spaced at a predetermined interval. Reference numerals 407A and 407B denote motors. The motor 407A is provided on the movable base 405 at the lateral outside area of the rows of horizontally continuously cast aluminum alloy rods 2 and is associated with the rail 406A. The motor 407B is provided on the movable base 405 at the lateral outside area of the rows of horizontally continuously cast aluminum alloy rods 2 and is associated with the rail 406B. Reference numerals 408A and 408B denote cutting machines which are driven by the motors 407A and 407B, respectively, and which each cut half of the rows of horizontally continuously cast aluminum alloy rods 2.

Reference numeral 409 denotes a movable-base clamp mechanism that is provided on the movable base 405 and press-clamps and releases rows of horizontally continuously cast aluminum alloy rods 2 by means of a hydraulic mechanism. Reference numeral 410 denotes a drive mechanism that is provided under the movable base 405 and is adapted to drive the movable base 405 upstream along the rows of horizontally continuously cast aluminum alloy rods 2 and to allow free movement of the movable-base clamp mechanism 409. Reference numeral 411 denotes a length detector that is located downstream of the movable base 405 and detects the length of the horizontally continuously cast aluminum alloy rods 2 to be cut.

Next, cutting of rows of horizontally continuously cast aluminum alloy rods 2 will be described. First, rows of horizontally continuously cast aluminum alloy rods 2 coming out from the respective molds 304 are supported and guided by the guide rollers 305, then horizontally pinched by the pinch roller mechanism 306 and conveyed at the same speed as the casting speed by means of a drive force of a drive mechanism (not shown). The thus conveyed rows of horizontally continuously cast aluminum alloy rods 2 are press-clamped by the synchronous clamp mechanism 402. At this time, the drive mechanism 403 allows free movement of the synchronous clamp mechanism 402. Thus, the synchronous clamp mechanism 402 moves as rows of horizontally continuously cast aluminum alloy rods 2 are conveyed.

During the above operation, the movable base 405 is moved upstream (toward the pinch roller mechanism 306) by the drive mechanism 410 and then stops upon arrival at a predetermined position. The drive mechanism 410 enters a standby state in which the same is freely movable in relation to the movable base 405. As soon as the leading ends of the rows of horizontally continuously cast aluminum alloy rods 2 that are being transferred abut the length detector 411, the movable-base clamp mechanism 409 clamps the rows of horizontally continuously cast aluminum alloy rods 2, and the cutting machines 408A and 408B operate. Since the movable base 405 moves together with the rows of horizontally continuously cast aluminum alloy rods 2, the horizontally continuously cast aluminum alloy rods 2 are cut perpendicular to their conveyance direction.

At this time, the cutting machines 408A and 408B move on the parallel rails 406A and 406B, respectively, and each cut half of the rows of horizontally continuously cast aluminum alloy rods 2 while moving from the lateral outside area toward the lateral inside of the rows of horizontally continuously cast aluminum alloy rods 2. As shown in FIG. 7, the leading ends of the thus cut rows of horizontally continuously cast aluminum alloy rods exhibit a stepped appearance. However, the next cutting operation renders equal the length between the cutting machine 408A and the corresponding leading ends of the rows of horizontally continuously cast aluminum alloy rods and the length between the cutting machine 408B and the corresponding leading ends of the rows of horizontally continuously cast aluminum alloy rods. Upon completion of cutting, the cutting machines 408A and 408B return to their original positions. At the same time, the movable-base clamp mechanism 409 is released, the movable base 405 is moved upstream by the drive mechanism 410 and then stops upon arrival at a predetermined position, and the drive mechanism 410 enters a standby state in which the same is freely movable.

Meanwhile, immediately after the movable-base clamp mechanism 409 clamps rows of horizontally continuously cast aluminum alloy rods 2, the synchronous clamp mechanism 402 releases the rows of horizontally continuously cast aluminum alloy rods 2. The synchronous clamp mechanism is moved upstream by the drive mechanism 403 and then stops upon arrival at a predetermined position, and the drive mechanism 403 enters a standby state in which the same is freely movable. Immediately before the movable-base clamp mechanism 409 releases the rows of horizontally continuously cast aluminum alloy rods 2 after the cutting machines 408A and 408B complete cutting of the rows of horizontally continuously cast aluminum alloy rods 2, the synchronous clamp mechanism 402 in a standby state clamps rows of horizontally continuously cast aluminum alloy rods 2 and moves together with the rows of horizontally continuously cast aluminum alloy rods 2.

Notably, when stepping feed is applied to the feed of the saw blades of the cutting machines 408A and 408B (to make high a feed rate during non-cutting including a feed rate during feed between the horizontally continuously cast aluminum alloy rods 2), the cutting time of one cycle of cutting can be shortened. Thus, application of stepping feed to the feed of the saw blades of the cutting machines 408A and 408B enables an increase in casting speed, as well as casting of a difficult-to-cut material.

As described above, the embodiment of the present invention provides a through, continuous process for casting the horizontally continuously cast aluminum alloy rods 2 and cutting the horizontally continuously cast aluminum alloy rods 2 to a standard length to yield horizontally continuously cast aluminum alloy rods. Thus, the horizontally continuously cast aluminum alloy rods can be continuously manufactured with high efficiency over a long period of time.

Figure 8:
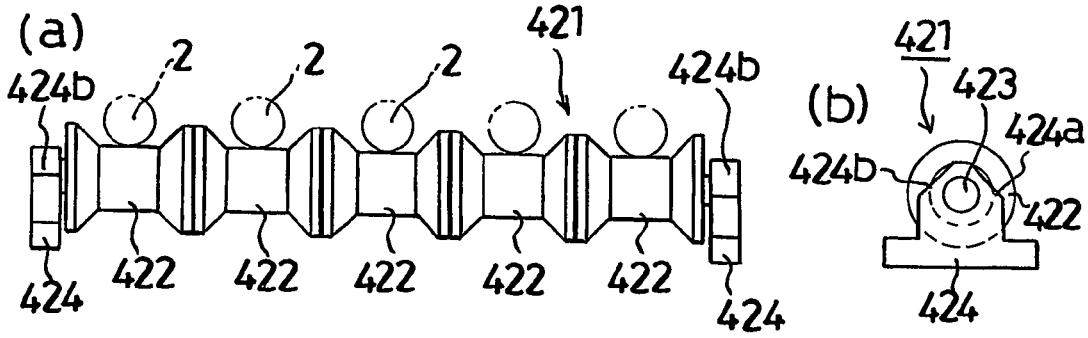
FIG. 8 is an explanatory view showing an example of a conveyance guide mechanism for use in the cutting mechanism or the like, FIG. 8(*a*) depicting a front view thereof and FIG. 8(*b*) a side view thereof.

FIG. 8(*a*) and FIG. 8(*b*) are explanatory views showing an example of a conveyance guide mechanism for use in, for example, the cutting mechanism 401. FIG. 8(*a*) is a front view, and FIG. 8(*b*) is a side view. In FIG. 8, reference numeral 421 denotes a conveyance guide mechanism that includes a plurality of conveyance guide rollers 422 for conveying and guiding horizontally continuously cast aluminum alloy rods 2 while being reciprocated, a support shaft 423 for rotatably supporting the plurality of conveyance guide rollers 422 and a pair of brackets 424 for supporting the support shaft 423. Each of the brackets 424 is configured such that the upper front-end portion thereof is inclined rearward to form an inclined surface 424*a*, whereas the upper rear-end portion thereof is inclined frontward to form an inclined surface 424*b*.

As mentioned above, the inclined surfaces 424*a* and 424*b* are provided on the upper front-end portion and on the upper rear-end portion, respectively, of each of the brackets 424. Thus, when, as mentioned previously, the conveyance guide mechanism 421 reciprocates in the longitudinal direction of the horizontally continuously cast aluminum alloy rods 2 in an interlocking relation with reciprocation of the synchronous clamp mechanism 402 and the movable-base clamp mechanism 409, an accidental collision of a horizontally continuously cast aluminum alloy rod 2 against the bracket 424 does not result in a problem that the horizontally continuously cast aluminum alloy rod 2 is bent or that the horizontally continuously cast aluminum alloy rod 2 runs off its course. Thus, there can be reduced occurrence of suspension of casting caused by, for example, bending of a horizontally continuously cast aluminum alloy rod 2, thereby enabling consistent, continuous operation over a long period of time.

Figure 9:
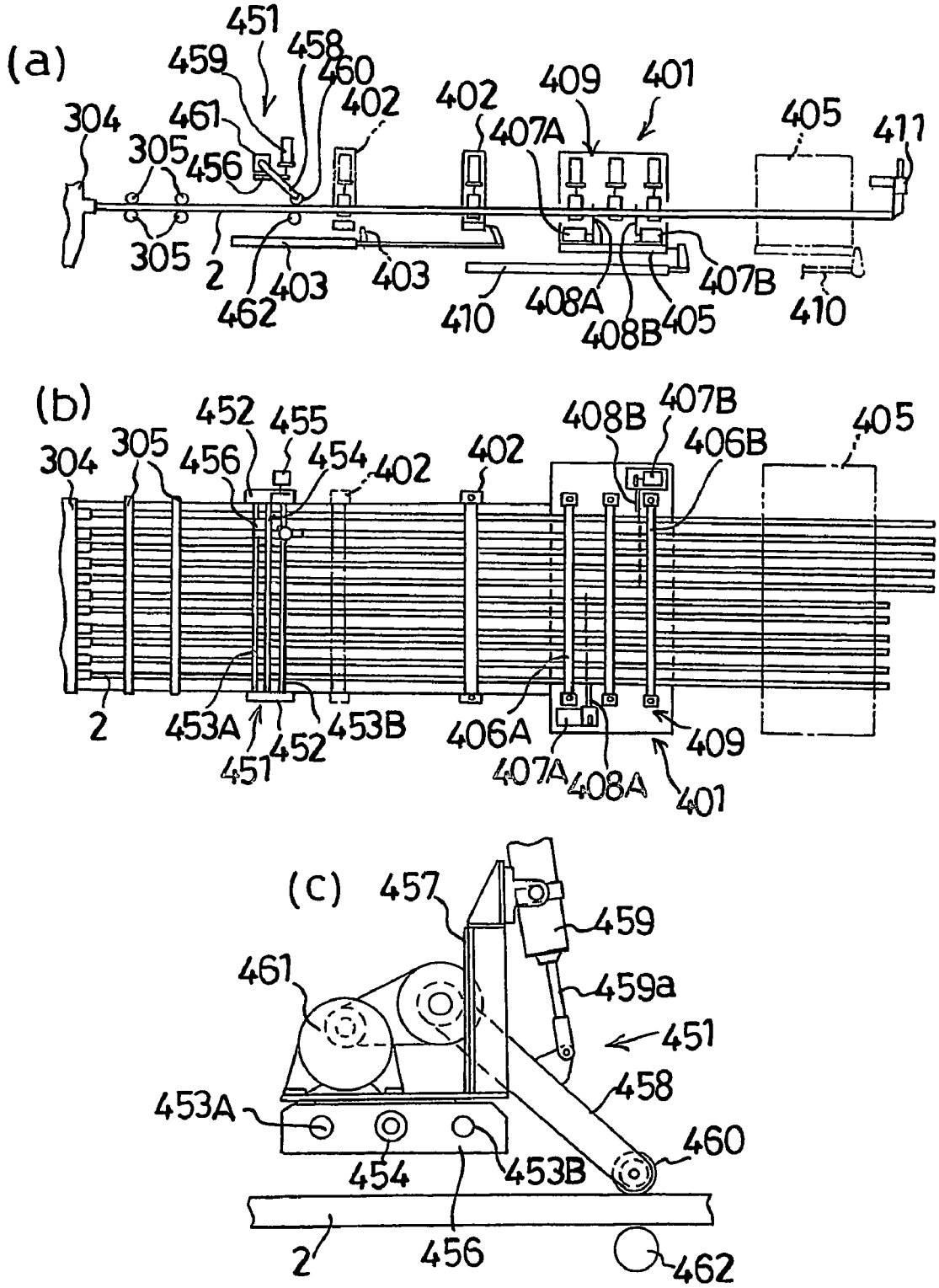
FIG. 9 is an explanatory view showing an example of a restart mechanism, FIG. 9(*a*) depicting a side view thereof, FIG. 9(*b*) a plan view thereof and FIG. 9(*c*) an enlarged side view thereof.

FIG. 9(*a*), FIG. 9(*b*) and FIG. 9(*c*) are explanatory views showing an example of the restart mechanism 451. FIG. 9(*a*) is a side view, FIG. 9(*b*) a plan view, and FIG. 9(*c*) an enlarged side view. The restart mechanism 451 is provided at the position of the pinch roller mechanism 306 shown in FIG. 7. However, the pinch roller mechanism 306 may be provided behind the restart mechanism 451. In FIG. 9, reference numeral 452 denotes a frame. The frames 452 are provided downstream of the guide rollers 305 and on opposite sides of rows of horizontally continuously cast aluminum alloy rods 2 in a mutually facing condition. Reference numerals 453A and 453B denote rails that are spaced at a predetermined interval and extend between the frames 452 perpendicular to rows of horizontally continuously cast aluminum alloy rods 2. Reference numeral 454 denotes a screw rod that extends between the frames 452 perpendicular to rows of horizontally continuously cast aluminum alloy rods 2 and in parallel with the rails 453A and 453B while a predetermined interval is established between the same and the rails 453A and 453B.

Reference numeral 455 denotes a drive motor that is attached to one frame 452 and rotates the screw rod 454 either in the regular direction or in the reverse direction. Reference numeral 456 denotes a pedestal that is screw-engaged with the screw rod 454 and can move, as the screw rod 454 rotates, along the rails 453A and 453B perpendicular to rows of horizontally continuously cast aluminum alloy rods 2. Reference numeral 457 denotes a support stand that is mounted on an upper portion of the pedestal 456. Reference numeral 458 denotes an arm whose one end (proximal end or upper end) is rotatably attached to the support stand 457 and which extends in such a manner as to define a plane together with a horizontally continuously cast aluminum alloy rod 2 and such that its other end is located in the plane below and downstream of the proximal end. Reference numeral 459 denotes a cylinder whose intermediate portion is rotatably attached to the support stand 457. The distal end of a rod 459*a* is rotatably attached to the distal end portion of the arm 458.

Reference numeral 460 denotes a feed roller which is attached to the distal end of the arm 458 and whose outer circumference abuts the outer circumference of a horizontally continuously cast aluminum alloy rod 2 to thereby feed the horizontally continuously cast aluminum alloy rod 2 downstream. Reference numeral 461 denotes a drive motor that is mounted on the pedestal 456, drives the feed roller 460, the outer circumference of which abuts the outer circumference of a horizontally continuously cast aluminum alloy rod 2, and can freely adjust the feed speed of the feed roller 460 within a range of zero to at least the casting speed (conveyance speed) of the horizontally continuously cast aluminum alloy rod 2. Reference numeral 462 denotes a support roller that supports a horizontally continuously cast aluminum alloy rod 2 that the feed roller 460 presses.

Next, the operation of the restart mechanism 451 will be described. In the steady state, as mentioned previously, the horizontally continuously cast aluminum alloy rods 2 are sequentially conveyed at the casting speed (conveyance speed) and cut to a predetermined length. When a problem arises in relation to a portion (one or more than one) of the horizontally continuously cast aluminum alloy rods 2 or when replacement of molds 304 becomes necessary, the synchronous clamp mechanism 402 and/or the movable-base clamp mechanism 409, for example, are caused to release a problematic horizontally continuously cast aluminum alloy rod 2. Then, the horizontally continuously cast aluminum alloy rod 2 is removed. Then, the relevant mold 304 is inspected, adjusted and, as needed, replaced with a new one. Subsequently, a starting dummy rod is set in the mold 304. Next, the drive motor 455 is operated to rotate the screw rod 454 so as to move the pedestal 456 to the position of the dummy rod and to bring the feed roller 460 above the dummy rod. Subsequently, the cylinder 459 is extended in order to increase the angle of depression of arm 458, thereby pressing the feed roller 460 against the dummy rod with a predetermined pressing force and thus clamping the dummy rod between the feed roller 460 and the support roller 462.

Then, casting is started and, at the same time, the feed roller 460 is rotated by means of the drive motor 461 to thereby convey the dummy rod in the conveyance direction. In so doing, the casting speed (conveyance speed) after restart is gradually increased, and the rotational speed of the drive motor 461 is adjusted so as to attain the regular conveyance speed such that the dummy-rod conveyance speed becomes equal to the conveyance speed of other horizontally continuously cast aluminum alloy rods 2. Next, after confirmation that the rotational speed of the feed roller 460 has reached the regular conveyance speed, the synchronous clamp mechanism 402 or the movable-base clamp mechanism 409 is caused to clamp the dummy rod. Also, the cylinder 459 is caused to retract so as to raise the feed roller 460, and then the drive motor 461 is stopped. In this manner, the horizontally continuously cast aluminum alloy rod 2, casting of which has restarted is returned to rows of horizontally continuously cast aluminum alloy rods 2.

As described above, when the cutting apparatus is provided with the restart mechanism 451, a mold 304 in which a problem has arisen can be inspected, adjusted or replaced with a new one to thereby resume casting of a horizontally continuously cast aluminum alloy rod 2. Therefore, a predetermined number of the horizontally continuously cast aluminum alloy rods 2 can be continuously cast at high efficiency.

Figure 10:
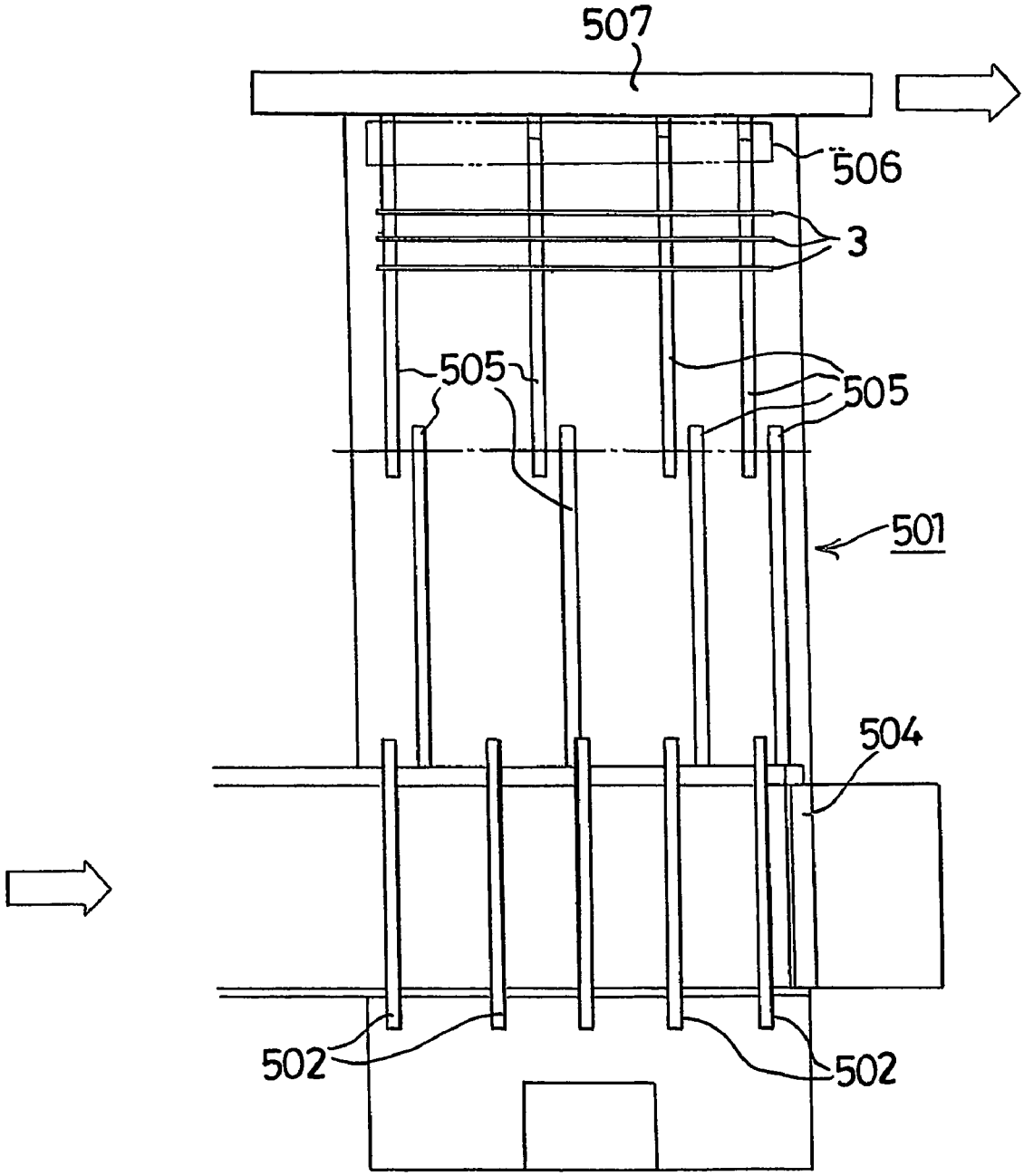
FIG. 10 is an explanatory view showing an example of a conveying apparatus.
Figure 11:
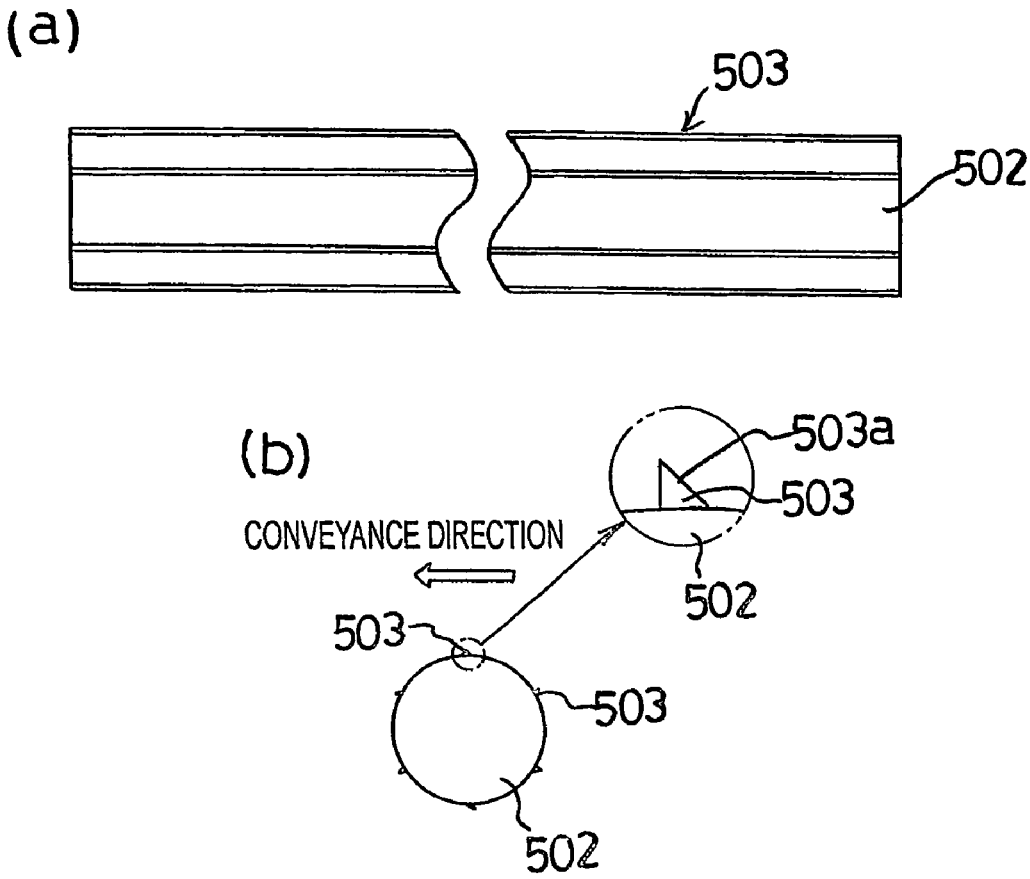
FIG. 11 is an explanatory view showing an example of a conveyance roller for use in the conveying mechanism, FIG. 11(*a*) depicting a front view thereof and FIG. 11(*b*) a partially enlarged side view thereof.

FIG. 10 is an explanatory plan view showing an example of the conveying apparatus 501. The conveying apparatus 501 is a combination of a mechanism for conveying horizontally continuously cast aluminum alloy rods 3 in the longitudinal direction and a mechanism for conveying the same in the lateral direction, This combination provides not only conveyance to the next step but also a buffer effect in relation to conveyance. Therefore, for example, the difference in processing speed between adjacent steps can be adjusted, or a detention process can be performed when a problem arises. Appropriate disposition of the conveying apparatus 501 between manufacturing steps enables consistent, continuous operation over a long period of time. FIG. 11(*a*) and FIG. 11(*b*) are explanatory views showing an example of a conveyance roller for use in the conveying mechanism 501. FIG. 11(*a*) is a front view, and FIG. 11(*b*) is a partially enlarged side view. In FIG. 10 and FIG. 11, reference numeral 502 denotes a conveyance roller that is an example of a mechanism for longitudinal conveyance. A drive mechanism (not shown) drives the conveyance rollers 502 to thereby convey the cut horizontally continuously cast aluminum alloy rods 3 in the longitudinal direction. Plural elongated projections 503 are formed on each of the conveyance rollers 502 in such a manner as to be circumferentially arranged at predetermined intervals. Each of the elongated projections 503 has an inclined surface 503*a* that rises from the upstream side toward the downstream side. Thus, the elongated projections 503 come into contact with the horizontally continuously cast aluminum alloy rods 3 in a scratching manner to thereby convey the horizontally continuously cast aluminum alloy rods 3 and allow the approaching horizontally continuously cast aluminum alloy rods 3 to move over the same.

Reference numeral 504 denotes a stopper that stops the horizontally continuously cast aluminum alloy rods 3 that are conveyed in the longitudinal direction by means of the conveyance rollers 502. Reference numeral 505 denotes a lateral-conveyance conveyor that is an example of a mechanism for lateral conveyance and assumes the form of a slat conveyor. The lateral-conveyance conveyors 505 convey the horizontally continuously cast aluminum alloy rods 3 in the lateral direction that is perpendicular to the longitudinal direction and have a retention function for temporarily retaining the horizontally continuously cast aluminum alloy rods 3.

Reference numeral 506 denotes a delivery mechanism that lifts and delivers to a longitudinal-conveyance conveyor 507 the horizontally continuously cast aluminum alloy rods 3 that are conveyed on the lateral-conveyance conveyors 505. The rods 3 are lifted and delivered in units each comprising four rods, for example. The delivery mechanism 506 is configured similarly to a delivery mechanism 603 used in the binding apparatus 601, which will be described later. The longitudinal-conveyance conveyor 507 conveys the horizontally continuously cast aluminum alloy rods 3, which are received from the delivery mechanism 506, to the binding apparatus 601 of the next step in the longitudinal direction of the horizontally continuously cast aluminum alloy rods 3.

Next, conveyance of the horizontally continuously cast aluminum alloy rods 3 will be described. First, the conveyance rollers 502 are rotated to convey the cut, horizontally continuously cast, aluminum alloy rods 3 in the longitudinal direction until they hit against the stopper 504 and are then caused to stop rotating.

Although not illustrated in FIG. 10, portions of the lateral-conveyance conveyors 505 that are located in the conveyance path of the conveyance rollers 502 are raised in order to laterally convey the horizontally continuously cast aluminum alloy rods 3 one after another to the delivery mechanism 506. Preferably, while the horizontally continuously cast aluminum alloy rods 3 are conveyed laterally, the horizontally continuously cast aluminum alloy rods 3 are monitored for a bending condition, and any excessively bent horizontally continuously cast aluminum alloy rod 3, which is visually judged defective, is removed. Next, the delivery mechanism 506 is operated while maintaining predetermined spacing capable of accommodating four flatly arrayed horizontally continuously cast aluminum alloy rods 3, thereby delivering the horizontally continuously cast aluminum alloy rods 3 in units each comprising four rods to the longitudinal-conveyance conveyor 507. The thus delivered horizontally continuously cast aluminum alloy rods 3 are conveyed to the binding apparatus 601 of the next step.

For example, when the conveying apparatus 501 is disposed between a step associated with the cutting mechanism 401 and a step associated with the stacking mechanism 602, by virtue of use of the lateral-conveyance conveyors 505 for conveying the horizontally continuously cast aluminum alloy rods 3, the following advantage is provided. When a problem occurs in, for example, the binding apparatus 601 of a later step, the horizontally continuously cast aluminum alloy rods 3 are retained until the problem is solved. Thus, the operation of casting the horizontally continuously cast aluminum alloy rods 2 (3) can be continued.

Figure 12:
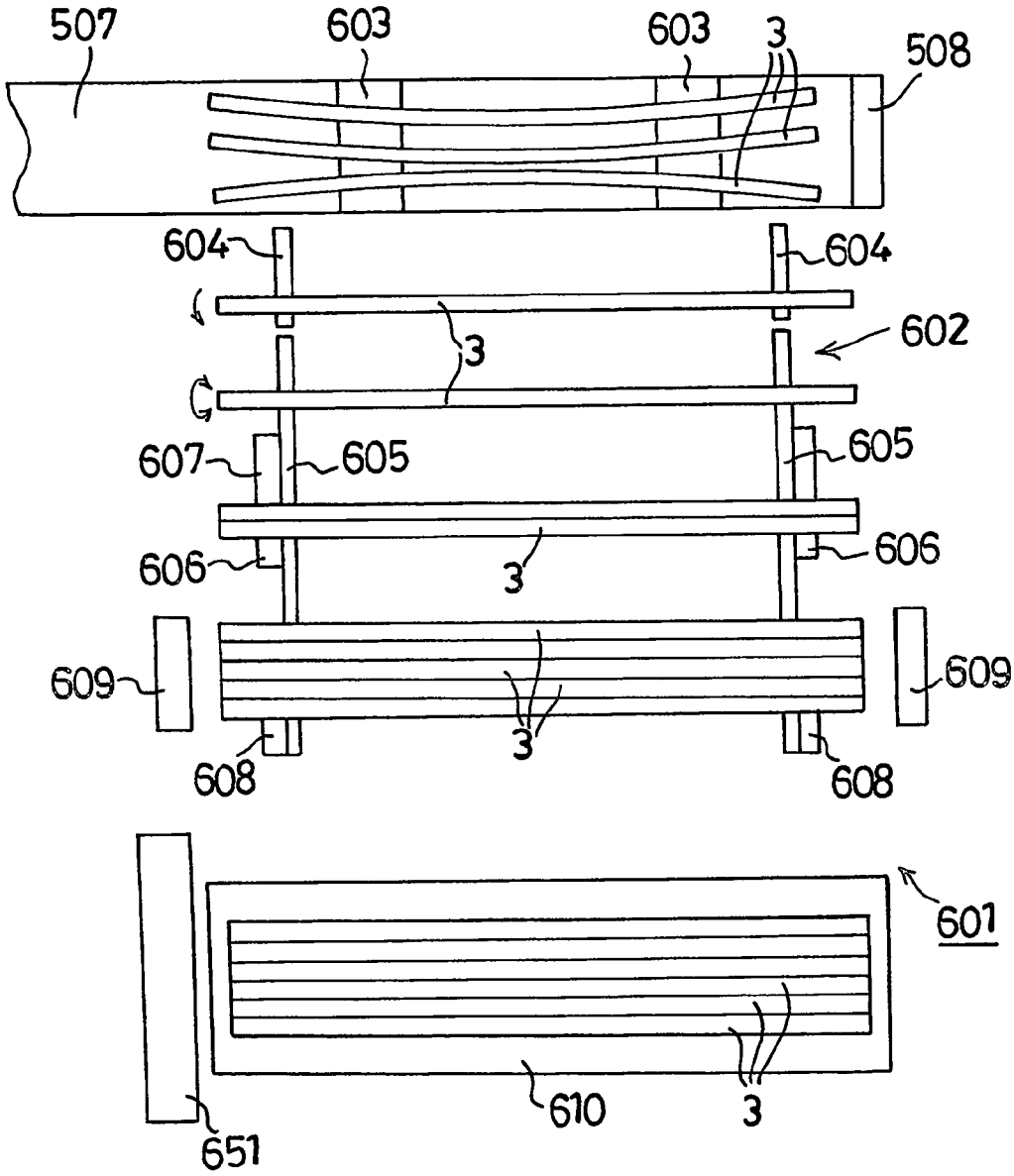
FIG. 12 is an explanatory view showing an example of a binding apparatus.
Figure 13:
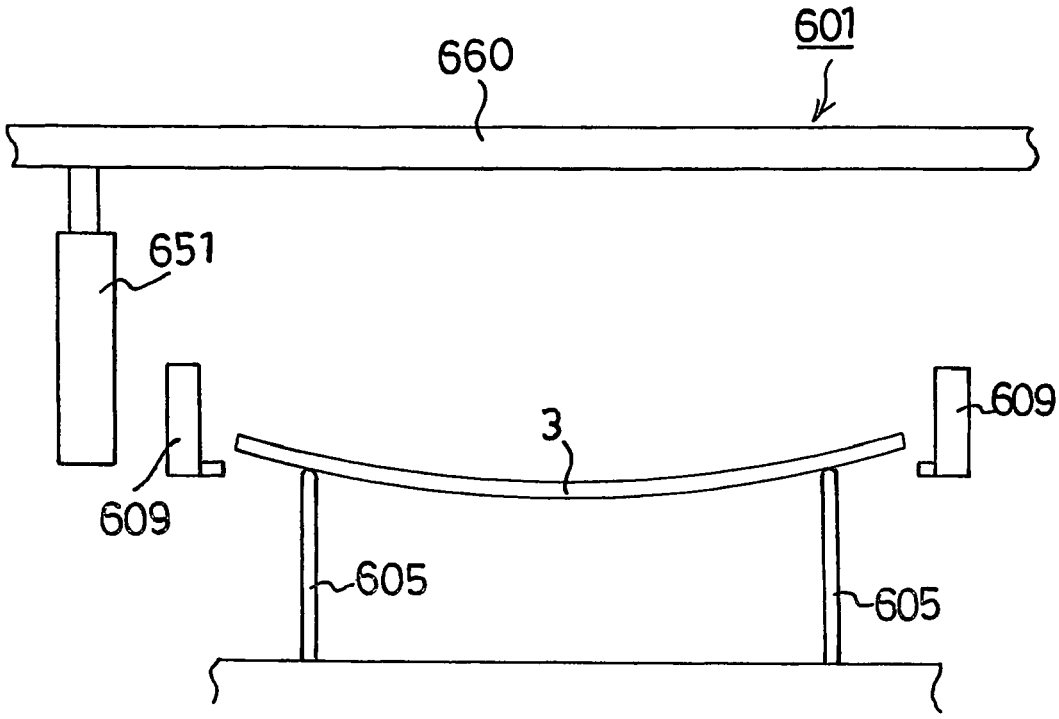
FIG. 13 is an explanatory view showing the example of a binding apparatus.
Figure 14:
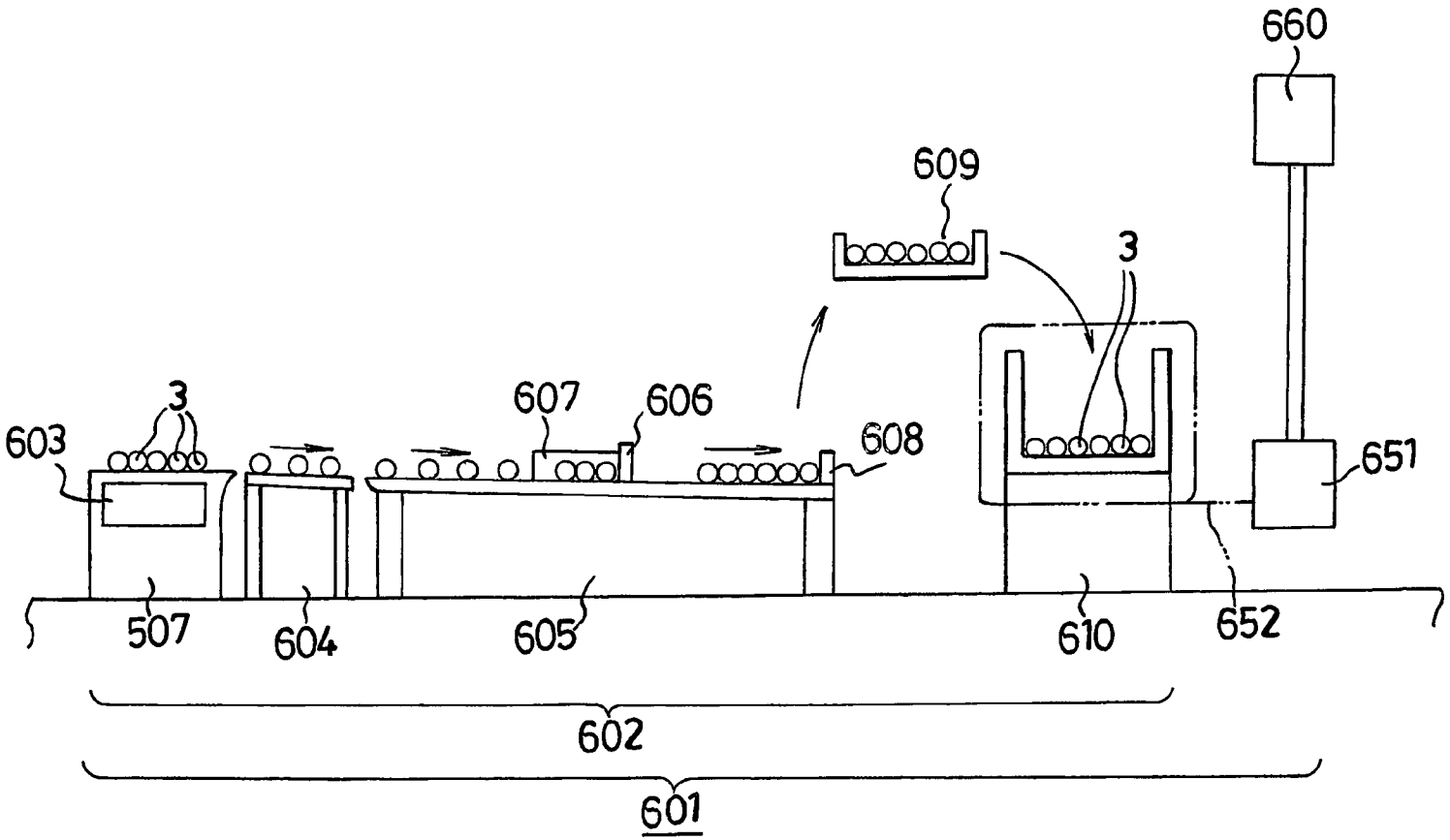
FIG. 14 is an explanatory view showing the example of a binding apparatus.

FIG. 12, FIG. 13 and FIG. 14 are explanatory views that show an example of the binding apparatus 601. FIG. 12 is a plan view, FIG. 13 is a side view and FIG. 14 is a plan view. In these figures, the binding apparatus 601 includes the stacking mechanism 602 for stacking the horizontally continuously cast aluminum alloy rods 3 and the binding mechanism 651 for binding, at a plurality of positions, the horizontally continuously cast aluminum alloy rods 3 that have been stacked by the stacking mechanism 602. A transfer mechanism 660 moves the binding mechanism 651 to predetermined positions along the longitudinal direction of the horizontally continuously cast aluminum alloy rods 3 and stops the binding mechanism 651 at the individual positions.

The stacking mechanism 602 includes a delivery mechanism 603, an intermediate delivery mechanism 604, a transfer mechanism 605, a first stopper 606, a counting delivery mechanism 607, a second stopper 608, a transfer mechanism 609 and a stacking mechanism 610. The delivery mechanism 603 lifts and delivers the horizontally continuously cast aluminum alloy rods 3, for example, in units each comprising four rods, which have been conveyed on the longitudinal-conveyance conveyor 507 and are stopped by a stopper 508. The intermediate delivery mechanism 604 receives the horizontally continuously cast aluminum alloy rods 3 delivered from the delivery mechanism 603 while supporting only opposite end portions of the horizontally continuously cast aluminum alloy rods 3 and conveys the horizontally continuously cast aluminum alloy rods 3 on its inclined surface in a rotating and/or sliding manner by utilization of their own weight. The transfer mechanism 605 receives the horizontally continuously cast aluminum alloy rods 3 delivered from the intermediate delivery mechanism 604 while supporting only opposite end portions of the horizontally continuously cast aluminum alloy rods 3 and conveys the horizontally continuously cast aluminum alloy rods 3 on its inclined surface in a rotating and/or sliding manner by utilization of their own weight. The first stopper 606 is for stopping, at a central portion of the transfer mechanism 605, the horizontally continuously cast aluminum alloy rods 3 that are conveyed on the transfer mechanism 605. The counting delivery mechanism 607 counts one by one and delivers the horizontally continuously cast aluminum alloy rods 3 that are stopped by the first stopper 606. The second stopper 608 is for stopping the horizontally continuously cast aluminum alloy rods 3 that have been counted by the counting delivery mechanism 607 and are conveyed on the transfer mechanism 605. The transfer mechanism 609, when a predetermined number is reached with respect to the horizontally continuously cast aluminum alloy rods 3 that are stopped by the second stopper 608 in such a manner as to be accumulated in close rows in the direction perpendicular to their longitudinal direction, transfers the horizontally continuously cast aluminum alloy rods 3 while supporting them at its opposite ends. The stacking mechanism 610 is for stacking in a predetermined number of layers the horizontally continuously cast aluminum alloy rods 3 received from the transfer mechanism 609 while supporting them at its opposite end portions.

Next, the operation of the binding apparatus 601 will be described under the assumption that the subsequent step is of batch-processing-like heat treatment. As shown in FIG. 12, the horizontally continuously cast aluminum alloy rods 3 that have been conveyed on the longitudinal-conveyance conveyor 507 and are stopped by the stopper 508 lie on the longitudinal-conveyance conveyor 507 while their bends face different directions. When the delivery mechanism 603 lifts the horizontally continuously cast aluminum alloy rods 3 in units each comprising four rods and delivers them to the intermediate delivery mechanism 604 by utilization of its inclined surface, the intermediate delivery mechanism 604 conveys the horizontally continuously cast aluminum alloy rods 3 in a rotating and/or sliding manner by utilization of its inclined surface and their own weight while supporting opposite end portions of the horizontally continuously cast aluminum alloy rods 3, thereby delivering the horizontally continuously cast aluminum alloy rods 3 to the transfer mechanism 605 and causing the transfer mechanism 605 to support the horizontally continuously cast aluminum alloy rods 3 at its opposite end portions.

The transfer mechanism 605 conveys the horizontally continuously cast aluminum alloy rods 3 in a rotating and/or sliding manner by utilization of their own weight and its inclined surface while supporting opposite end portions of the horizontally continuously cast aluminum alloy rods 3. As shown in FIG. 13, in the course of such conveyance, before arriving at the position of the first stopper 606, the individual horizontally continuously cast aluminum alloy rods 3 are arranged such that their bends face downward. Then, the horizontally continuously cast aluminum alloy rods 3 are stopped by the first stopper 606. The horizontally continuously cast aluminum alloy rods 3 that are stopped by the first stopper 606 are counted one by one by the counting delivery mechanism 607 and then delivered downstream on the transfer mechanism 605 while, for example, being supported at their opposite end portions in such a manner as to move over the first stopper 606. The thus delivered horizontally continuously cast aluminum alloy rods 3 slide to the position of the second stopper 608 and stop there.

When a predetermined number of the horizontally continuously cast aluminum alloy rods 3 are stopped by the second stopper 608 and arranged in a planar condition while their bends face downward as shown in FIG. 13, the transfer mechanism 609 transfers the horizontally continuously cast aluminum alloy rods 3 to the stacking mechanism 610 while holding the horizontally continuously cast aluminum alloy rods 3 in an end-aligned manner, and stacks them in the stacking mechanism 610. This transfer-stacking operation is repeated. When a predetermined number is reached with respect to the number of layers in which the horizontally continuously cast aluminum alloy rods 3 are stacked in the stacking mechanism 610, the stacked horizontally continuously cast aluminum alloy rods 3 are bound with tie bands 652 at several longitudinal positions by means of the binding mechanism 651, which is moved in the longitudinal direction of the horizontally continuously cast aluminum alloy rods 3 by the transfer mechanism 660, and are then conveyed to the heat treatment apparatus 701 of the next step. In the present invention, the expression "opposite end portions to be supported" refers to a region on which the supporting action is exerted and encompasses a region located inward from each of opposite ends.

As described above, in the binding apparatus 601, the horizontally continuously cast aluminum alloy rods 3 are conveyed and stacked while being supported at their opposite end portions. Thus, as shown in FIG. 13, the horizontally continuously cast aluminum alloy rods 3 are conveyed and stacked such that their bends face downward. Therefore, the horizontally continuously cast aluminum alloy rods 3 are bound such that their bends face the same direction and thus such that the horizontally continuously cast aluminum alloy rods 3 are closely stacked, whereby occurrence of a stack shift can be prevented. Notably, the transfer mechanism 605 may be formed of a conveyor that supports only the opposite end portions of the horizontally continuously cast aluminum alloy rods 3. The counting delivery mechanism 607 may be a mere counter such that output from the counter causes the second stopper 608 to stop the horizontally continuously cast aluminum alloy rods 3 or allows free movement of the horizontally continuously cast aluminum alloy rods 3 so that the horizontally continuously cast aluminum alloy rods 3 can slide. Preferably, in order to control a workflow, a monitor camera is installed in the vicinity of the binding apparatus 601 so that the periphery of the binding apparatus 601 can be monitored for occurrence of any problem.

The thus stacked horizontally continuously cast aluminum alloy rods 3 are conveyed into a heat treatment furnace of the heat treatment apparatus 701, undergo batch heat treatment, are delivered from the heat treatment furnace, are conveyed to the unbinding apparatus 801 and are unbound so as to allow individual handling thereof. When the stacking and binding steps are to be omitted, heat treatment may be performed such that the horizontally continuously cast aluminum alloy rods 3 are passed individually or in a bundle through a movable heat treatment furnace. Although not illustrated, by use of an arraying apparatus 901 having the conveying mechanism shown in FIG. 10, the unbound horizontally continuously cast aluminum alloy rods 3 are delivered from the unbinding apparatus 801 to a conveyor that longitudinally conveys the unbound horizontally continuously cast aluminum alloy rods 3 so as to array the horizontally continuously cast aluminum alloy rods 3 in the longitudinal direction. Alternatively, the unbound horizontally continuously cast aluminum alloy rods 3 are conveyed laterally by means of a conveyor and stopped by a stopper, and arrayed by use of the arraying apparatus 901 having a configuration similar to that of, for example, the stacking mechanism 602, followed by being forwarded to the conveyor that longitudinally conveys the unbound horizontally continuously cast aluminum alloy rods 3. The thus-longitudinally-arrayed horizontally continuously cast aluminum alloy rods 3 are fed to the subsequent step (a straightening machine, a peeling apparatus or a nondestructive inspection apparatus). Preferably, the form of array is determined so as to be compatible with an inlet to the subsequent step. For example, the array may be a single-row array. The arraying apparatus 901 is a combination of a mechanism for longitudinally conveying horizontally continuously cast aluminum alloy rods 3 and a mechanism for laterally conveying horizontally continuously cast aluminum alloy rods 3. This combination provides not only conveyance to the next step but also a buffer effect in relation to conveyance. Therefore, for example, the difference in processing speed between adjacent steps can be adjusted, or a detention process can be performed when a problem arises. Appropriate disposition of the arraying apparatus 901 between manufacturing steps enables consistent, continuous operation over a long period of time.

The thus cast and cut horizontally continuously cast aluminum alloy rod 3 has a heterogeneous microstructure typified by an inverse segregation layer formed in a surface thereof. A portion of such a heterogeneous microstructure causes cracking in the course of plastic working and thus must be removed. However, since an as-cast, small-diameter, horizontally continuously cast aluminum alloy rod 3 is bent along the longitudinal direction, heat treatment after casting increases the degree of bending. For example, a horizontally continuously cast aluminum alloy rod 3 having a small diameter equal to or less than 60 mm is bent to a level not ignorable in relation to subjection to processing by the peeling apparatus 1101 or the nondestructive inspection apparatus 1301.

For example, when a horizontally continuously cast aluminum alloy rod 3 subjected to peeling by the peeling apparatus 1101 has a bend of 5 mm/1,000 mm or more, runout occurs during peeling, causing formation of an unpeeled portion or uneven peeling. Thus, preferably, in order to carry out continuous, through manufacture of horizontally continuously cast aluminum alloy rods 3 having consistent surface quality, the horizontally continuously cast aluminum alloy rods 3 are adjusted in bending to less than 5 mm/1,000 mm (preferably, 2 mm/1,000 mm or less) before being subjected to peeling by the peeling apparatus 1101. As a result, consistent, through, continuous operation can be performed more readily. Notably, AAA mm/1,000 mm means that the quantity of bend is AAA mm per a longitudinal length of 1,000 mm.

When a bend is 5 mm/1,000 mm or more, there becomes uneven the clearance between a detector of, for example, an eddy-current inspection apparatus, which serves as the nondestructive inspection apparatus 1401, and the circumferential surface of a horizontally continuously cast aluminum alloy rod 3 to be inspected. As a result, inspection results may become inconsistent. Also, when a horizontally continuously cast aluminum alloy rod 3 passes through a guide bush that is provided at an entrance to, for example, the nondestructive inspection apparatus 1401 in order to suppress unevenness in clearance, the surface of the horizontally continuously cast aluminum alloy rod 3 may receive a scratch as a result of contact with the guide bush. When a bend is 5 mm/1,000 mm or more, play of a horizontally continuously cast aluminum alloy rod 3 during conveyance increases, and thus passing smoothness is impaired during the horizontally continuously cast aluminum alloy rod 3 passing through the guide bush. As a result, in ultrasonic inspection, a problem arises in that a surface echo and a bottom echo are detected as defect echoes. Therefore, a bend is preferably suppressed to less than 5 mm/1,000 mm (more preferably 2 mm/1,000 mm or less, further preferably 0.5 mm/1,000 mm or less). As a result, consistent, continuous, through operation can be performed more readily.

Preferably, a roll-type straightening machine is used to eliminate the above-mentioned bend from a horizontally continuously cast aluminum alloy rod 3. The roll-type straightening machine functions such that a horizontally continuously cast aluminum alloy rod 3 is passed between, for example, a roller having a concave profile and a roller having a convex profile to thereby be lessened in bend. Preferably, a concave-profiled roller and a convex-profiled roller are selected in accordance with straightening conditions. Working conditions are set through adjustment of a roll angle, a pressing load and a rotational roller speed. As a result, since a bend is lessened, the frequency of occurrence of a problem during conveyance or feed to apparatus decreases. Therefore, through, continuous operation can be performed more readily.

Figure 15:
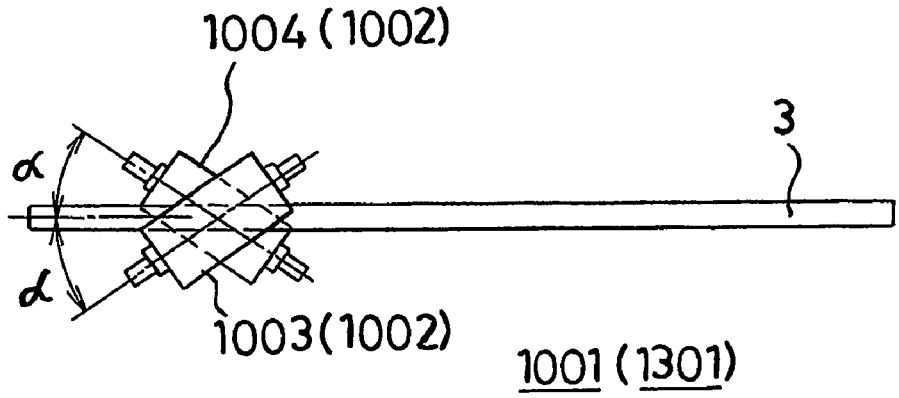
FIG. 15 is an explanatory view showing an example of a first straightening machine, FIG. 15(*a*) depicting a plan view thereof and FIG. 15(*b*) a side view thereof.
Figure 15:
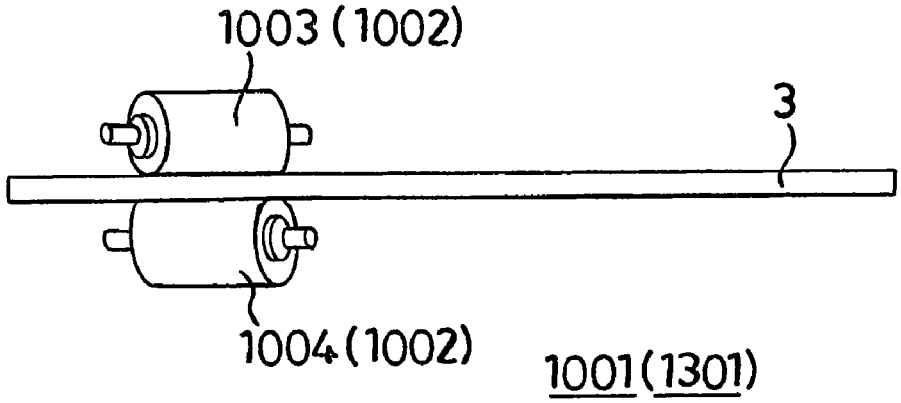

FIG. 15(*a*) and FIG. 15(*b*) are explanatory views that show an example of the first straightening machine 1001. FIG. 15(*a*) is a plan view, and FIG. 15(*b*) is a side view. In FIG. 15, reference numeral 1002 denotes a pair of rollers that are disposed such that their axes intersect as viewed in plane and consist of an upper concave-profiled roller 1003 and a lower convex-profiled roller 1004. Adjacent pairs of rollers 1002 are optimally set in accordance with the outside diameter of a horizontally continuously cast aluminum alloy rod 3 to be straightened. Symbol $\alpha$ denotes a roll angle.

Next, straitening of bends in a horizontally continuously cast aluminum alloy rod 3 will be described. First, at least either rollers 1003 or rollers 1004 of pairs of rollers 1002 are rotated by means of a drive mechanism (not shown). Then, a horizontally continuously cast aluminum alloy rod 3 is introduced into, for example, the rightmost pair of rollers 1002 so as to pass between the rollers 1003 and 1004 of the pair. The horizontally continuously cast aluminum alloy rod 3 is fed leftward while rotating, whereby bend and out-of-roundness are eliminated therefrom.

Adjustment of the roll angle $\alpha$ adjusts the contact distance between a continuously cast aluminum-alloy rod 3 and the concave-profiled roller 1003. Thus, even when the cross section of a continuously cast aluminum-alloy rod 3 as cast is out of roundness, bending can be straightened efficiently.

The range of an inverse segregation layer, which is an example of casting surface to be removed, of the thus straightened horizontally continuously cast aluminum alloy rod 3 depends on the composition of the associated horizontally continuously cast aluminum alloy rod 2 at the time of casting, mold structure, casting conditions and the like. For example, the inverse segregation layer ranges from the surface to a depth of about 1 mm. Notably, a region ranging from the surface to a depth of about 1 mm may includes a defect that results from contact of the molten aluminum alloy 1 with the mold 304, lubricant or gas and is another example of casting surface to be removed. Preferably, a region whose range is two times or more the above-mentioned range from the surface is removed.

Figure 16:
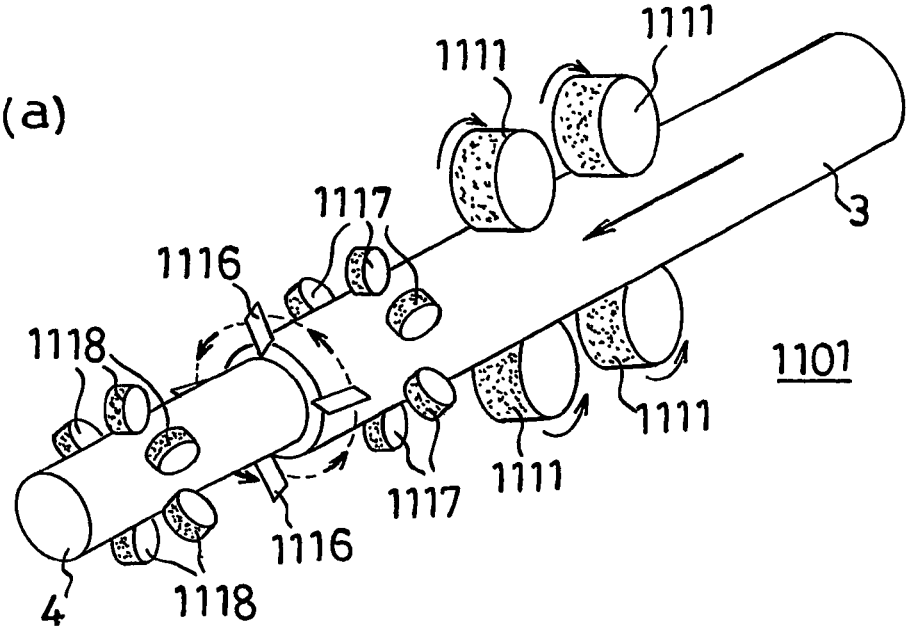
FIG. 16 is an explanatory view showing an example of a peeling apparatus, FIG. 16(*a*) depicting a perspective view thereof, with a cutting-blade drive mechanism omitted, and FIG. 16(*b*) a side view of support rollers thereof.
Figure 16:
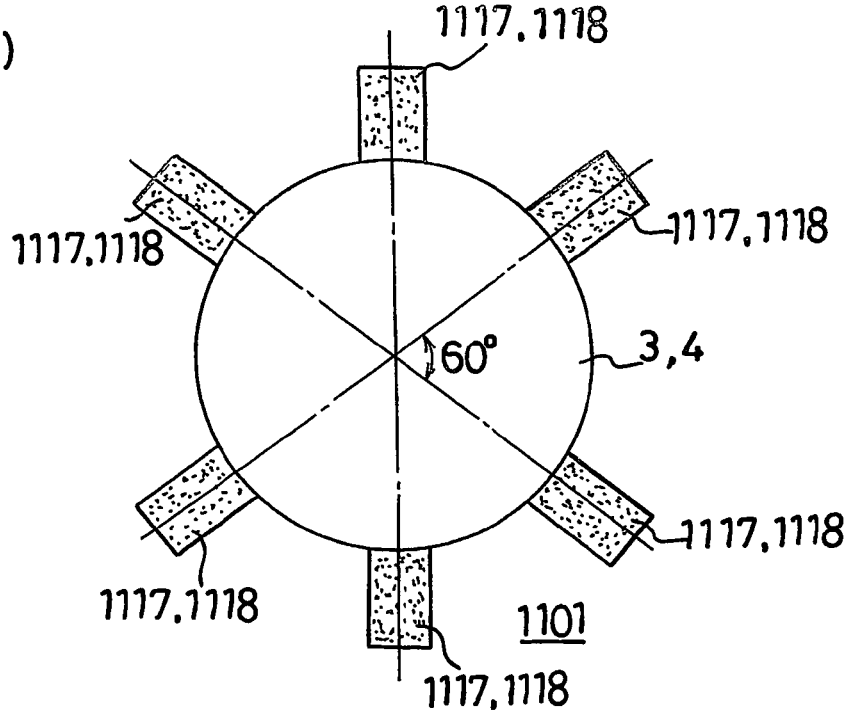

FIG. 16(*a*) and FIG. 16(*b*) are explanatory views that show an example of the peeling apparatus 1101. FIG. 16(*a*) is a perspective view that does not include a cutting-blade drive mechanism, and FIG. 16(*b*) is a side view showing support rollers. In FIG. 16, reference numeral 1111 denotes a conveyance roller. As viewed laterally, four conveyance rollers 1111 convey a horizontally continuously cast aluminum alloy rod 3 while holding the horizontally continuously cast aluminum alloy rod 3 from above and below. The adjacent conveyance rollers 1111 are spaced at a predetermined interval in accordance with the length of the horizontally continuously cast aluminum alloy rods 3 to be conveyed. Reference numeral 1116 denotes a cutting blade. Four cutting blades 1116 are disposed circumferentially at 90-degree intervals around a horizontally continuously cast aluminum alloy rod 3 that is conveyed longitudinally by the conveyance rollers 1111, so as to completely cut off a skin portion of the horizontally continuously cast aluminum alloy rod 3. The cutting blades 1116 are rotationally driven by means of a cutting-blade mechanism (not shown). Reference numeral 1117 denotes a support roller. The support rollers 1117 support a horizontally continuously cast aluminum alloy rod 3 that is to undergo peeling, so as to prevent play of the horizontally continuously cast aluminum alloy rod 3. Reference numeral 1118 denotes a support roller. The support rollers 1118 support the horizontally continuously cast aluminum alloy rod 4 that has undergone peeling, so as to prevent play of the horizontally continuously cast aluminum alloy rod 4. The support rollers 1117 and 1118 support the horizontally continuously cast aluminum alloy rods 3 and 4, respectively, while being disposed circumferentially at 60-degree intervals.

Next, peeling of a horizontally continuously cast aluminum alloy rod 3 will be described. First, the conveyance rollers 1111 are rotated by means of a drive mechanism (not shown), and the cutting blades 1116 are rotated by means of a cutting-blade drive mechanism (not shown). A horizontally continuously cast aluminum alloy rod 3 is introduced between the conveyance rollers 1111. The conveyance rollers 1111 feed the horizontally continuously cast aluminum alloy rod 3 leftward. A skin portion (casting surface that is of heterogeneous microstructure) of the thus fed horizontally continuously cast aluminum alloy rod 3 is completely cut off by the rotating cutting blades 1116, thereby yielding a horizontally continuously cast aluminum alloy rod 4 having a predetermined diameter.

In contrast to a conventionally used lathe, the peeling apparatus 1101 does not involve rotation of a workpiece to be peeled (horizontally continuously cast aluminum alloy rod 3), but involves rotation of a cutting mechanism section (cutter head and cutting blades), exertion of a propulsive force on the workpiece by pairs of conveyance rollers 1111 and cutting of the workpiece by passing it through the cutting mechanism section. Thus, cutting can be performed continuously with a handling time of zero. In contrast to a lathing process in which the length of a workpiece is finite due to handling-related restrictions, the present skin-portion-removing process (peeling process) theoretically accepts a workpiece having an infinite length, thereby providing good productivity. Therefore, a peeling machine is advantageous. Particularly, in the case of cutting a small-diameter workpiece (having, for example, a diameter of 20 mm to 100 mm), since the workpiece itself is considerably bent, a peeling process has an advantage over a lathing process, which is likely to leave an uncut portion of the workpiece. Preferably, chips that are generated as a result of removing casting surface by means of the peeling apparatus 1101 are continuously broken and returned to the melting step. For example, chips are broken into small pieces by use of a chip breaker, and the thus generated small pieces are conveyed under pressure by means of compressed air. The above feature eliminates the need to temporarily collect generated chips and the need for an operator to transport the collected chips by use of a forklift or the like, so that through, continuous operation can be performed more readily.

When a skin portion is removed from a continuously cast aluminum alloy rod 3 by the peeling apparatus 1101, a bending of, for example, 3 mm/1,000 mm or more may arise on the resultant continuously cast aluminum alloy rod 4 due to cutting resistance or the like. Also, the continuously cast aluminum alloy rod 4 that has undergone cutting effected by the peeling apparatus 1101 has a cutting mark that is, for example, a roughness of about 100 μm, on its surface. In the case of some working conditions to be imposed on the continuously cast aluminum alloy rod 4, the cutting mark may remain on a forged product as a mark.

Thus, the continuously cast aluminum-alloy rod 4 must be straightened by use of the second straightening machine 1301 that has a configuration similar to that of the first straightening machine 1001, and a cutting mark must be eliminated. Through adjustment of the roll angle $\alpha$, the bending of the continuously cast aluminum alloy rod 4 reduces, and a cutting mark is hardly formed, whereby a near mirror surface is attained. Thus, through, continuous operation can be performed more readily.

When the thus peeled, straightened, continuously cast aluminum alloy rod 4 has a defect in its surface or internal portion, a product that is formed therefrom through plastic working becomes a defective. Therefore, the continuously cast aluminum-alloy rods 4 must be inspected for an internal defect by means of the nondestructive inspection apparatus 1401. The above internal inspection can be performed on an ingot. However, since a rough ingot surface disturbs inspection accuracy, the internal inspection is preferably performed after the peeling step that imparts a smooth surface condition to the continuously cast aluminum alloy rod 4. Preferably, the nondestructive inspection apparatus 1401 includes the first nondestructive inspection apparatus 1410 and the ultrasonic flaw detection apparatus 1450 (second nondestructive inspection apparatus). Preferably, the first nondestructive inspection apparatus 1410 includes the encircling eddy-current flaw detection apparatus 1420 and the rotary eddy-current flaw detection apparatus 1430. However, the first nondestructive inspection method (apparatus) may be an image-processing inspection method (apparatus) for detecting a surface portion defect in an continuously cast aluminum alloy rod 4 by processing an image of a surface of the continuously cast aluminum alloy rod 4, or a visual inspection method for visually detecting a surface portion defect in a continuously cast aluminum alloy rod 4. The first nondestructive inspection method (apparatus) may be at least one selected from among the eddy-current inspection method (apparatus), the image-processing method (apparatus), the visual inspection method and other such methods (apparatuses).

The eddy-current flaw detection apparatus judges whether or not a defect is present, from a change in eddy current that is induced on the surface of an inspection subject through utilization of an electromagnetic induction phenomenon. The eddy-current flaw detection apparatus includes a coil serving as a detector, signal-processing means and judgment means for forming pass-fail judgment through comparison of a processed signal with preset conditions and for outputting a pass-fail result. The encircling eddy-current flaw detection apparatus 1420 detects a change in eddy current that is induced while an inspection subject (continuously cast aluminum-alloy rod 4) is moving through a coil. Preferably, the encircling eddy-current flaw detection apparatus 1420 is used to inspect a surface layer portion that is a region ranging from the surface to a depth of 3 mm. An inspection range can be set through adjustment of the excitation frequency of a coil used to generate eddy current.

The rotary eddy-current flaw detection apparatus 1430 detects a change in eddy current induced on the surface of an inspection subject (continuously cast aluminum-alloy rod 4)

in such a manner that small coils disposed around the inspection subject rotate round the inspection subject. The rotary eddy-current flaw detection apparatus 1430 allows a reduction of the size of a probe and thus can detect a fine defect that is a defect in a region ranging from the surface to a depth of 1 mm (extreme surface). An inspection range can be set through adjustment of the excitation frequency of a coil used to generate eddy current. Notably, inspection by the ultrasonic flaw detection apparatus 1450 involves a dead zone ranging, for example, from the surface to a depth of 2 mm. In order to compensate for the dead zone, the first nondestructive inspection apparatus 1410, which includes the encircling eddy-current flaw detection apparatus 1420 and the rotary eddy-current flaw detection apparatus 1430, is used.

Preferably, an ultrasonic inspection apparatus is used as the second nondestructive inspection apparatus 1401. The ultrasonic inspection apparatus includes a probe, signal-processing means and judgment means for forming pass-fail judgment through comparison of a processed signal with preset conditions and for outputting a pass-fail result. Ultrasonic inspection can inspect an internal portion of an inspection subject (horizontally continuously cast aluminum alloy rod 4) through observation of behavior, within the inspection subject, of ultrasonic waves emitted from the probe. X-ray radiography is another choice for internal inspection. X-ray radiography requires high-voltage apparatus for generating X rays and thus involves troublesome equipment management. For reasons of its principle, X-ray radiography exhibits high inspection capability in relation to inspection of a voluminous defect, such as foreign matter and cavities, but exhibits low inspection capability in relation to inspection of a defect, such as a crack, of a size 0.5% or less of the diameter of the horizontally continuously cast aluminum alloy rod 4 in the surface thereof onto which X-rays are projected. By contrast, ultrasonic inspection exhibits high inspection capability even in relation to inspection of a crack. As compared with X-ray radiography that requires image-processing, ultrasonic inspection processes a detected electric signal and thus facilitates automatic judgment on a defect. Therefore, ultrasonic inspection can be performed consistently with high accuracy. It is noted that the second nondestructive inspection method (apparatus) may be at least one of an X-ray inspection method (apparatus) and an ultrasonic inspection method (apparatus).

Examples of an ultrasonic inspection technique for use in the present invention include reflection technique, penetration technique, angle beam technique, surface wave technique, resonance technique and contact-scanning technique. Examples of a medium include water, machine oil, water glass, grease and Vaseline. Examples of a measuring method include a contact method, an immersion method, a pulse-wave method, a continuous-wave method, a 2-probe method, a 1-probe method and a multiple-reflection method. The present invention can use a method of receiving a signal stemming from reflection or penetration of an emitted ultrasonic pulse signal and detecting the presence of a defect from a change (reflection, interception or attenuation) in the received signal.

Figure 17:
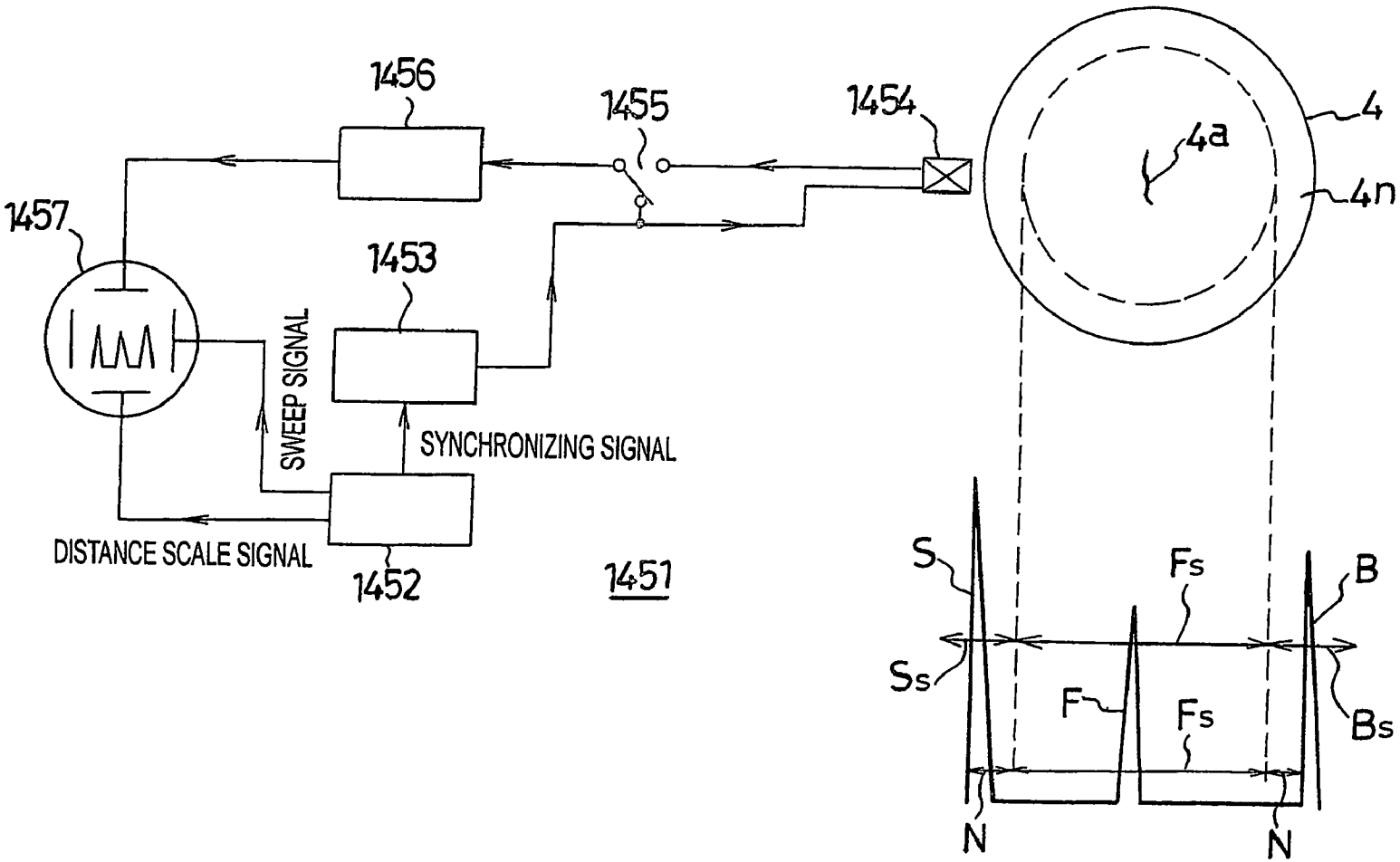
FIG. 17 is an explanatory view showing a normal beam method that employs ultrasonic pulse reflection technique.

FIG. 17 is an explanatory view showing a normal beam method that employs ultrasonic pulse reflection technique, which method is a nondestructive inspection method. In FIG. 17, reflected waves (echoes) to be displayed on a display section are shown under the horizontally continuously cast aluminum alloy rod 4 in association with regions of the horizontally continuously cast aluminum alloy rod 4. In FIG. 17, reference numeral 1451 denotes a reflection-type ultrasonic flaw detection apparatus having an example of signal-processing means. The apparatus includes a synchronizer section 1452, a transmitter section 1453, a probe 1454, a changeover section 1455, a receiver section 1456 and a display section 1457. The synchronizer section 1452 outputs a synchronizing signal, a sweep signal and a distance scale signal. The transmitter section 1453 outputs a voltage of an ultra-high-frequency signal synchronized with the synchronizing signal output from the synchronizer section 1452. The probe 1454 emits an ultra-high-frequency signal based on the voltage of the ultra-high-frequency signal output from the transmitter section 1453 toward the horizontally continuously cast aluminum alloy rod 4, captures a reflected wave from the surface of or a defect 4*a* in the horizontally continuously cast aluminum alloy rod 4 and converts the captured reflected wave into voltage. The changeover section 1455 supplies an output of the transmitter section 1453 to the probe 1454 or supplies voltage associated with a reflected wave captured by the probe 1454 to a receiver section 1456. The receiver section 1456 amplifies voltage of the probe 1454 having captured a reflected wave and outputs the amplified voltage via the changeover section 1455. The display section 1457 displays a change with time of a reflected wave on the basis of an output of the receiver section 1456 and the sweep and distance scale signals output from the synchronizer section 1452. In FIG. 17, symbol Ss denotes a surface echo range, symbol S a surface echo of the horizontally continuously cast aluminum alloy rod 4, symbol Fs a flaw-detection echo range of the horizontally continuously cast aluminum alloy rod 4, symbol F a defect echo stemming from the defect 4*a* in the horizontally continuously cast aluminum alloy rod 4, symbol Bs a bottom echo range, symbol B a bottom echo of the horizontally continuously cast aluminum alloy rod 4, symbol N a dead zone located at each of opposite sides of the flaw-detection echo range Fs. Notably, the waveform displayed on the display section 1457 is displayed synchronously with the surface echo S.

Next, detection of the defect 4*a* in the horizontally continuously cast aluminum alloy rod 4 will be described. First, when the surface echo S within the surface echo range Ss exceeds a threshold value, flaw detection starts. When the bottom echo B within the bottom echo range Bs drops below the threshold valve, flaw detection ends. Therefore, when the defect echo F in excess of the threshold value is present within the flaw-detection echo range Fs located between the surface echo range Ss and the bottom echo range Bs, the defect echo F indicates that the defect 4*a* is present at the position of the defect echo F.

Preferably, flaw detection by the reflection-type ultrasonic flaw detection apparatus 1451 uses a frequency of 2 MHz to 8 MHz. An appropriate probe 1454 is selected in view of its diameter, material, angle of beam spread and the like. Ultrasonic waves incident on the horizontally continuously cast aluminum alloy rod 4 propagate linearly and then spread. When the linear propagation distance or near acoustic field length is too long, a defect in a small-diameter rod cannot be detected. Therefore, the probe 1454 that can provide optimum sensitivity must be selected in accordance with the size of the horizontally continuously cast aluminum alloy rod 4. In order to enhance S/N ratio, material or the like must be considered so as to obtain a sufficient waveform even at a low amplification degree. In order to reduce the number of probes 1454 and to increase flaw-detection speed, the angle of beam spread must be considered.

Preferably, in flaw detection, a clearance is formed between the probe 1454 and the horizontally continuously cast aluminum alloy rod 4, and the clearance is filled with a medium. This is because, even when the surface roughness of the horizontally continuously cast aluminum alloy rod 4 is uneven, ultrasonic waves can consistently impinge on the horizontally continuously cast aluminum alloy rod 4. Preferably, water or machine oil is used as the medium since use of such medium lessens attenuation of ultrasonic waves.

Working sensitivity of flaw detection can be adjusted by a bottom echo method or a reference block method. In the bottom echo method, the sensitivity of a flaw detection apparatus is adjusted such that an echo from the bottom of a sound portion of a test sample assumes a predetermined output value. It must be noted that the bottom echo method is susceptible to the surface roughness of the horizontally continuously cast aluminum alloy rod 4, with resultant instability of sensitivity. In the reference block method, the sensitivity of a flaw detection apparatus is adjusted such that an echo from a reference block having a standard hole assumes a predetermined output value.

In view of variations in surface roughness and use of a plurality of probes 1454, the reference block method is preferred for inspection of the horizontally continuously cast aluminum alloy rod 4 of the present invention.

Next, a dead zone 4*n* will be described. In FIG. 17, the dead zone 4*n* is an outer circumferential portion (located outside the dotted line) of the horizontally continuously cast aluminum alloy rod 4. Examples of the cause for occurrence of the dead zone 4*n* include conveyance play, varying distances between the inspection apparatus and the rod which are attributed to the bend of the horizontally continuously cast aluminum alloy rod 4, spreading of the width of a transmitted pulse (ultrasonic wave), and a near acoustic field. In particular, lessening of conveyance play is effective. Conveyance play is the most influential in relation to occurrence of the dead zone 4*n*.

Examples of a method for suppressing the dead zone 4*n* will be described specifically. An appropriate combination of the methods can suppress the dead zone 4*n* to a predetermined width or less. First, measures to cope with play will be described. A guide bush and a guide roller are disposed before and after the probe 1454 so as to suppress the bend of the horizontally continuously cast aluminum alloy rod 4 and play of the horizontally continuously cast aluminum alloy rod 4 during conveyance. Employment of the above measures prevents a predetermined waveform from falling outside the flaw-detection echo range Fs, which could otherwise result from abrupt runout of a flaw-detection subject (horizontally continuously cast aluminum alloy rod 4) during inspection. Employment of a structure that suppresses vibration induced by moving onto a conveyance roller can lessen play to less than a predetermined degree.

Next, measures to cope with near acoustic field will be described. In the case of a normal incidence probe, a region in the vicinity of the probe 1454 where a sound wave does not spread, and a sound field is disturbed is called a "near acoustic field." In a region that is located more distant than is the near acoustic field, ultrasonic sound pressure decreases as the distance increases. The range of the near acoustic field is called a "near acoustic field length (x)" and generally represented by $x=d^2/(4\times\lambda)$, where d is the diameter (mm) of the probe 1454, and $\lambda$ is the wavelength (mm) of an ultrasonic wave. Since the near acoustic field portion disables flaw-detection or causes inconsistent flaw-detection results, the near acoustic field becomes the dead zone 4*a*. This is because it is assumed that the near acoustic filed corresponds to a saggy portion of the surface wave (S wave). Preferably, however, the probes 1454 are arranged in opposition to each other across a flaw-detection subject. Each of the probes 1454 is set in such a manner as to inspect a portion of the flaw-detection subject located on the far side of the center of the flaw-detection subject (a region biased toward the bottom from the center between a surface wave and a bottom wave is used for flaw detection), whereby influence of the near acoustic field can be eliminated. Also, employment of a probe 1454 and frequency conditions that involve a narrow near acoustic field is important.

Next, measures to cope with runout stemming from bend will be described. A flaw-detection subject is somewhat bent. Such a flaw-detection subject is conveyed longitudinally at a speed of several tens of meters per minute by means of a conveyance apparatus and enters a measuring station where the ultrasonic-inspection probe 1454 is disposed. For example, in the case where a bend of 5 mm/1,000 mm or more is present, when a flaw-detection subject enters or leaves a holder on which the probe 1454 is mounted, the flaw-detection subject comes into contact with the holder to a certain extent because of the bend, and a play of the flaw-detection subject arises. This play has adverse effect on flaw detection. Preferably, as a measure against the above problem, bend is removed by means of previously described straightening. Making the probe 1454 well follow the profile of a flaw-detection subject is also important.

Other measures will be described. In the case of an immersion method, in which the distance between the probe 1454 and a flaw-detection subject is long, when the flaw-detection echo range Fs is set by means of an absolute position as measured from the probe 1454, a flaw-detection region varies depending on the positional accuracy of the flaw-detection subject. In order to avoid the above problem, the surface echo range Ss that has a sufficient width is set beforehand in the vicinity of the position where a surface wave arises. The position of the thus set surface echo range Ss serves as a starting point for setting the flaw-detection echo range Fs. The flaw-detection echo range Fs is set in accordance with information regarding the surface echo range Ss at all times and at high speed. Thus, the influence of a conveyance play of a flaw-detection subject and a like factor can be avoided.

Figure 18:
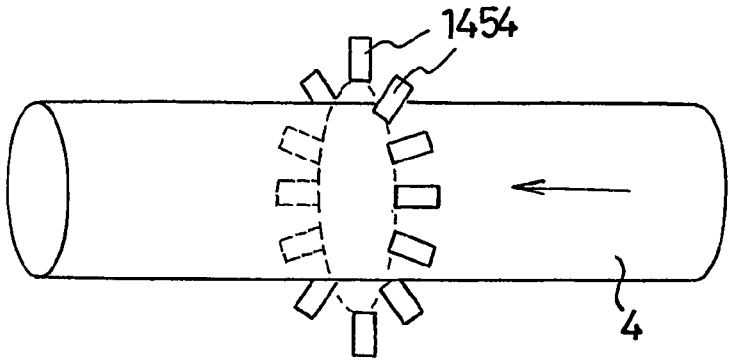
FIG. 18 is an explanatory view showing an example of an ultrasonic inspection method.

Preferred examples of an ultrasonic inspection method will be described. Preferably, as shown in FIG. 18, the ultrasonic inspection method is such that a plurality of probes 1454 are disposed around the circumference of a longitudinally moving inspection subject (flaw-detection subject: horizontally continuously cast aluminum alloy rod 4), so that inspection covers the entire region of the inspection subject. Since conveyance of an inspection subject involves only a linear motion along the longitudinal direction, a conveyance apparatus to be employed can be inexpensive. An example of means for moving an inspection subject in the longitudinal direction is a roller conveyor. The probes 1454 are arranged such that a drop in flaw (defect 4*a*) detection sensitivity does not exceed a predetermined degree. This arrangement is determined in view of an allowable degree of drop in sensitivity, the angle of beam spread of the probe 1454 and the like.

Figure 19:
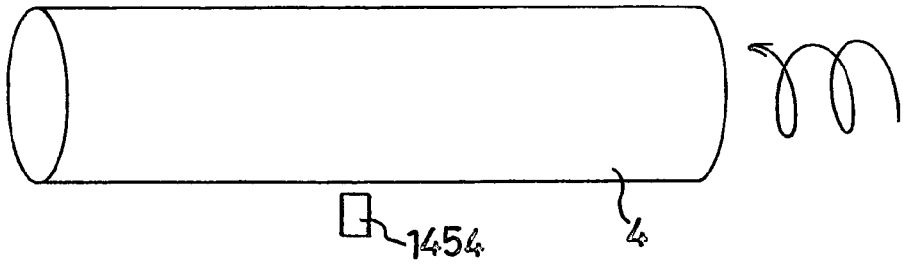
FIG. 19 is an explanatory view showing another example of an ultrasonic inspection method.

Preferably, as shown in FIG. 19, the ultrasonic inspection method is such that the stationary probe 1454 spirally scans an inspection subject that moves longitudinally while rotating, so that inspection covers the entire region of the inspection subject. Since the number of the probes 1454 can be reduced, a flaw detection apparatus to be employed can be inexpensive. Examples of means for longitudinally moving an inspection subject while rotating the same include the first straightening apparatus 1001 shown in FIG. 15 and a spiral feed conveyor. Preferably, the term "spirally" indicates that the pitch of the spiral track is within the spread width of an ultrasonic wave. This is because the entire region can be inspected without involvement of a drop in inspection capability.

Figure 20:
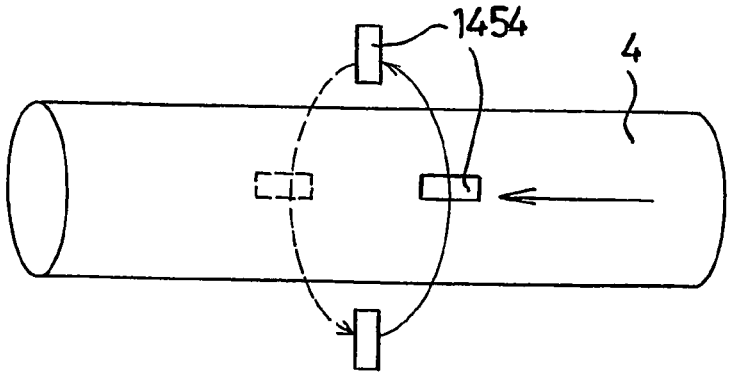
FIG. 20 is an explanatory view showing still another example of an ultrasonic inspection method.

Preferably, as shown in FIG. 20, the ultrasonic inspection method is such that the probes 1454 rotate along the circumference of a longitudinally moving inspection subject, so that inspection covers the entire region of the inspection subject. Since the number of the probes 1454 is small, and conveyance of an inspection subject is of a linear motion along the longitudinal direction, high-speed flaw detection is possible.

Figure 21:
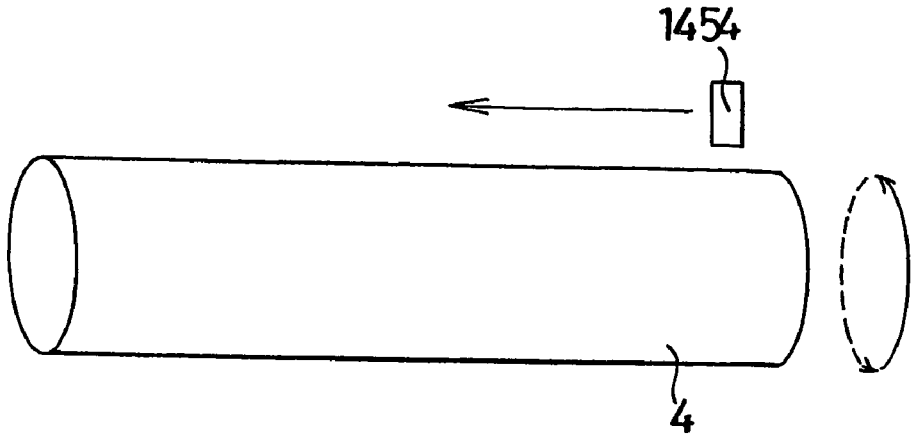
FIG. 21 is an explanatory view showing yet another example of an ultrasonic inspection method.

Preferably, as shown in FIG. 21, the ultrasonic inspection method is such that the probe 1454 moves along the longitudinal direction of an inspection subject that rotates without moving longitudinally, so that inspection covers the entire region of the inspection subject. This is because flaw detection can be performed by use of a small number of the probes 1454, and, in some cases, flaw detection can be performed while following a cutting work. An example of means for rotating an inspection subject is a lathe. Preferably, the rotational speed of an inspection subject and the speed of the probe 1454 moving along the longitudinal direction of the inspection subject are such that one pitch of the relative spiral track is within the spread width of an ultrasonic wave. This is because the entire region can be inspected without involvement of a drop in inspection capability.

The first sorting apparatus 1510 sends to the rotary eddy-current flaw detection apparatus 1430 of the next step a continuously cast aluminum-alloy rod 4 that has been judged non-defective in inspection by the encircling eddy-current flaw detection apparatus 1420, and sends to the first storage yard 1610 a continuously cast aluminum-alloy rod 4 that has been judged defective in inspection by the encircling eddy-current flaw detection apparatus 1420. The second sorting apparatus 1520 sends to the ultrasonic flaw detection apparatus 1450 of the next step a continuously cast aluminum-alloy rod 4 that has been judged non-defective in inspection by the rotary eddy-current flaw detection apparatus 1430, and sends to the second storage yard 1620 a continuously cast aluminum-alloy rod 4 that has been judged defective in inspection by the rotary eddy-current flaw detection apparatus 1430. The third sorting apparatus 1530 sends to the packing apparatus 1701 of the next step a continuously cast aluminum-alloy rod 4 that has been judged non-defective in inspection by the ultrasonic flaw detection apparatus 1450, and sends to the third storage yard 1630 a continuously cast aluminum-alloy rod 4 that has been judged defective in inspection by the ultrasonic flaw detection apparatus 1450.

Next, the feedback of inspection result will be described. When inspection was carried out, many of surface flaw-defects detected by eddy-current inspection were found to stem from the peeling step. The encircling eddy-current flaw detection apparatus 1420 could detect not only surface flaws stemming from the peeling step but also rather-deep-portion defects. The blade of a cutting tool is caught by a rather-deep-portion defect in the process of cutting in the peeling step, thereby inducing a defect. However, such induction of a defect does not mean that the peeling apparatus 1101 has a problem, but stems from the casting step. Many of defects detected by the rotary eddy-current flaw detection apparatus 1430 were surface defects stemming from the peeling step. Thus, the cutting control apparatus 2001 feeds back the results of eddy-current inspection to the peeling apparatus 1101 so as to adjust the rotational speed of a main shaft of the peeling apparatus 1101, the feed rate of a workpiece and timing of replacing cutting tools, whereby occurrence of a surface flaw can be suppressed. Since a rather-deep-portion defect detected by the encircling eddy-current flaw detection apparatus 1420 stems from the casting step, feedback to the continuous casting apparatus 301 is preferred in relation to detection of a rather-deep-portion defect. Many of internal defects detected by the ultrasonic flaw detection apparatus 1450 were found to stem from the casting step. Thus, the casting control apparatus 2101 feeds back the results of ultrasonic inspection to the horizontally continuously casting apparatus 301 so as to adjust the temperature of the molten aluminum alloy 1, casting speed (feed rate), lubricant feed conditions and the like, whereby occurrence of an internal defect can be suppressed.

Through feedback of eddy-current inspection results to the peeling step and feedback of ultrasonic inspection results to the casting step, occurrence of a defect can be suppressed as described below. First, generally, eddy-current inspection can be performed at an inspection speed of 100 m/min or more. However, ultrasonic inspection cannot sufficiently exhibit its inspection capability unless the inspection speed is about 10 m/min. Thus, their processing capabilities are compatible with each other in terms of application to a continuous line. Next, the number of surface defects detected by eddy-current inspection is greater than the number of internal defects detected by ultrasonic inspection. Thus, by first removing surface defects, which are greater in quantity and are detected by eddy-current inspection, the overall processing capability of inspection can acquire balance, and occurrence of a defect can be readily suppressed. Since ultrasonic inspection is performed in water, i.e., by an immersion method, the above practice can avoid the problem in that when an inspection subject that has undergone ultrasonic inspection and thus has a wetted surface is subjected to eddy-current inspection, the measuring accuracy is prone to drop. Thus, consistent, through, continuous operation can be readily implemented.

Figure 23:
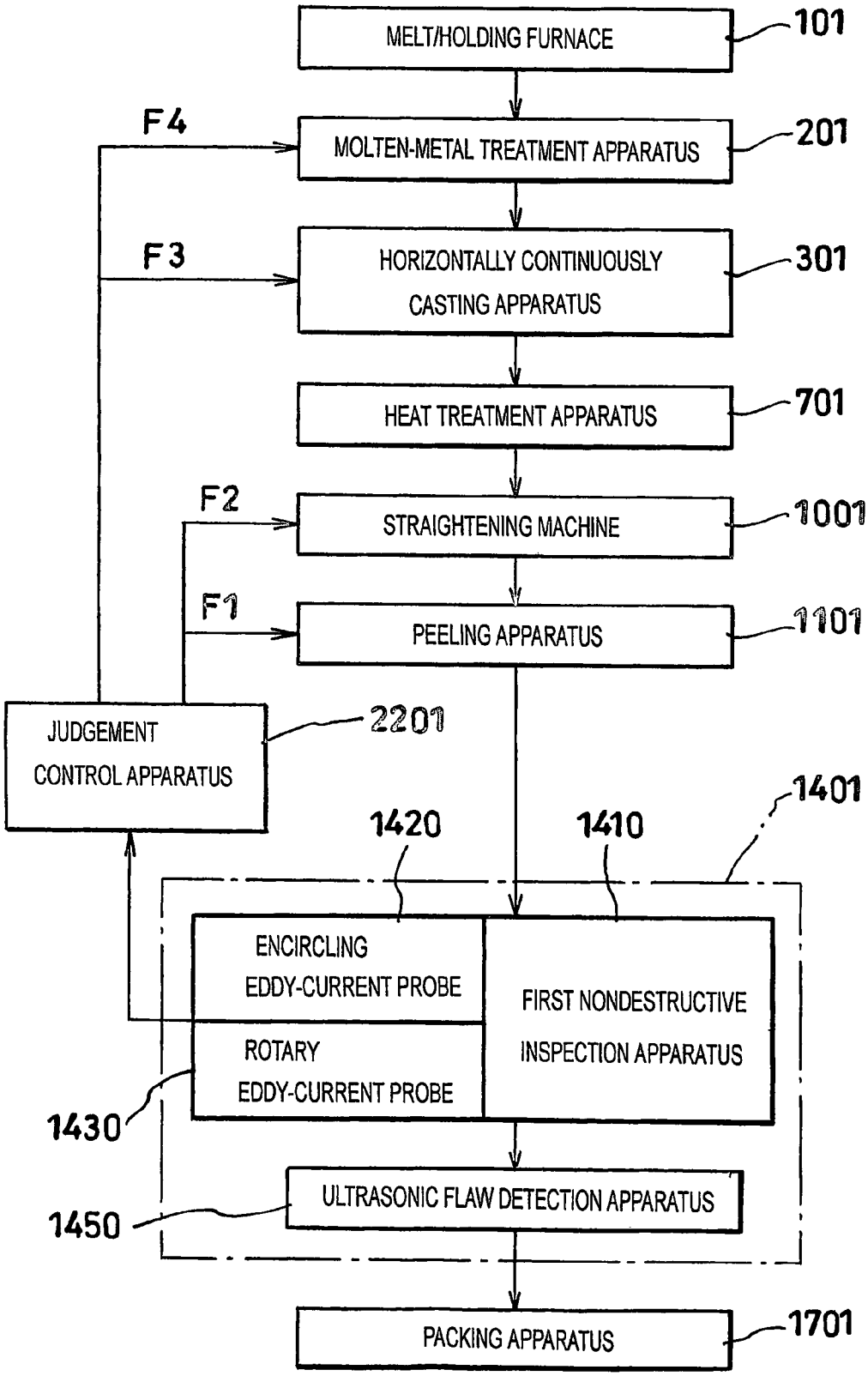
FIG. 23 is part of a flowchart that specifies equipment for manufacturing horizontally continuously cast aluminum alloy rods according to another embodiment of the present invention.

Another example of the nondestructive inspection method will be described. FIG. 23 is an explanatory view showing part of equipment for manufacturing continuously cast aluminum alloy rods according to another embodiment of the invention, in which the same reference numerals as in FIG. 1 and FIG. 2 are given to the components the same as or similar to those in FIG. 1 and FIG. 2. In FIG. 23, a nondestructive inspection apparatus 1401 comprises a first nondestructive inspection apparatus (first nondestructive inspection step) 1310 that combines an encircling eddy-current flaw detection apparatus 1420 and a rotary eddy-current flaw detection apparatus 1430 to inspect whether or not a defect is present in the surface portion of a workpiece to be inspected and an ultrasonic flaw detection apparatus (second nondestructive inspection apparatus, second nondestructive inspection step) 1450 that inspects an internal defect of the workpiece. In FIG. 23, reference numeral 2201 denotes a judgment control apparatus that performs a feedback based on outputs of the encircling eddy-current flaw detection apparatus 1420 and rotary eddy-current flaw detection apparatus 1430 as will be described later.

Figure 24:
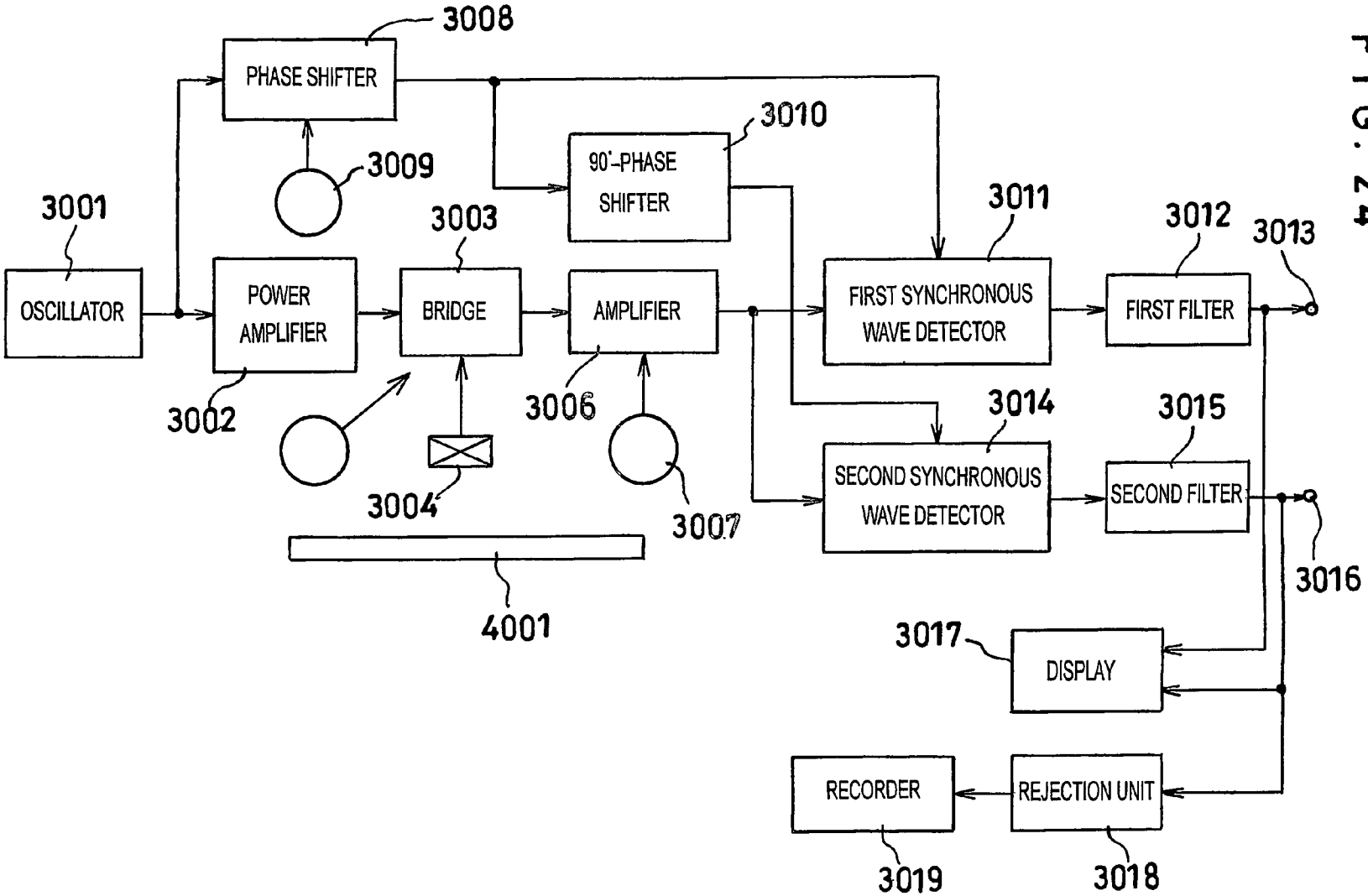
FIG. 24 is a block diagram showing an example of the eddy-current flaw detection apparatus constituting the first nondestructive inspection apparatus shown in FIG. 23.

FIG. 24 is a block diagram illustrating the eddy-current flaw detection apparatus (encircling eddy-current detection apparatus (encircling eddy-current detection step)) 1420 and the rotary eddy-current detection apparatus (rotary eddy-current detection step) 1430 constituting the first nondestructive inspection apparatus 1410. In FIG. 24, reference numeral 3001 denotes an oscillator that outputs sine wave AC voltage, 3002 a power amplifier that amplifies the output from the oscillator 3001, and 3003 a bridge supplied with electric power from the power amplifier 3002. The bridge 3003 has a probe 3004 incorporated therein and a bridge equilibrium adjuster 3005 connected thereto for removing non-equilibrium voltage and extracting a signal. Reference numeral 3006 denotes an amplifier that amplifies the output of the bridge 3003 and can be adjusted in amplification degree by an amplification degree adjuster 3007. Reference numeral 3008 denotes a phase shifter that shifts the phase of the output from the oscillator 3001 and can be adjusted in phase by a phase adjustor 3009. Reference numeral 3010 denotes a 90°-phase shifter that shifts the phase of the output from the phase shifter 3008 by 90°. Reference numeral 3011 denotes a first synchronous wave detector that is supplied with the outputs from the amplifier 3006 and phase shifter 3008 and extracts a specific phase component signal (reference phase signal). Reference numeral 3012 denotes a first filter that removes noise from the output of the first synchronous wave detector 3011, and numeral 3013 a first output terminal that is supplied with the output of the first filter 3012. Reference numeral 3014 denotes a second synchronous wave detector that is supplied with the outputs from the amplifier 3006 and 90°-phase shifter 3010 and extracts a specific phase component signal (phase signal 90°-shifted from the reference phase signal). Reference numeral 3015 denotes a second filter that removes noise from the output of the second synchronous wave detector 3014, and numeral 3016 a second output terminal that is supplied with the output from the second filter 3015. Using the first and second synchronous wave detectors 3011 and 3014 enables the real number and imaginary number of the complex voltage relative to the reference phase to be output. Reference numeral 3018 denotes a rejection unit that suppresses passage of a signal of a level less than a given level in relation to the amplitude of the signal supplied from the second filter 3015 to suppress noise, and numeral 3019 a recorder that records the output from the rejection unit 3018. The above is a fundamental configuration of the eddy-current flaw detection apparatus. Notably, reference numeral 4001 denotes a workpiece to be detected, and numeral 4002 a defect in the workpiece.

Figure 25:
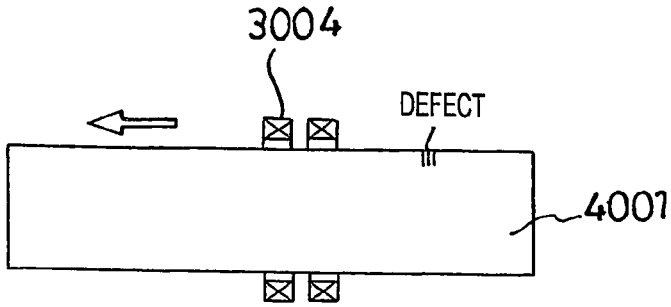
FIG. 25 is an explanatory view showing the probe of FIG. 24 used as an encircling probe.
Figure 26:
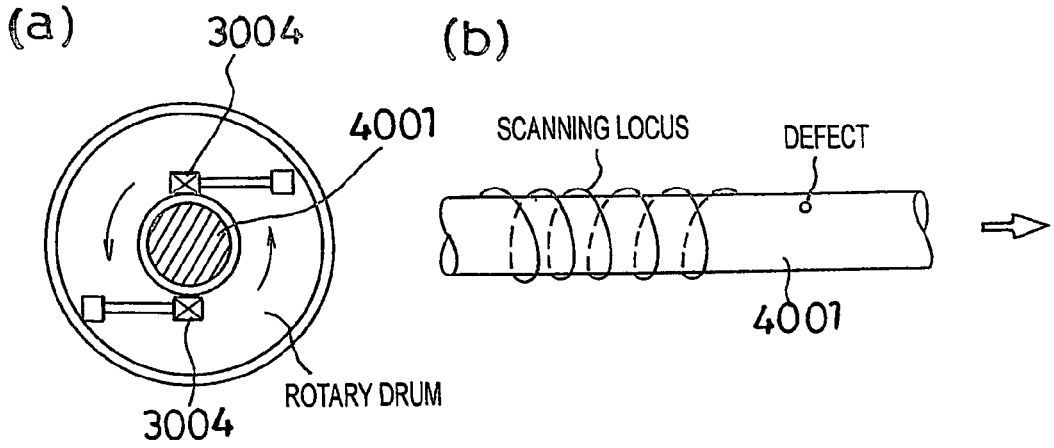
FIG. 26(*a*) and FIG. 26(*b*) are explanatory views showing the probe of FIG. 24 used as a rotary probe.

FIG. 25 is an explanatory view showing the probe of FIG. 24 used as an encircling probe, and FIG. 26(*a*) and FIG. 26(*b*) are explanatory views showing the probe of FIG. 24 used as a rotary probe.

Figure 27:
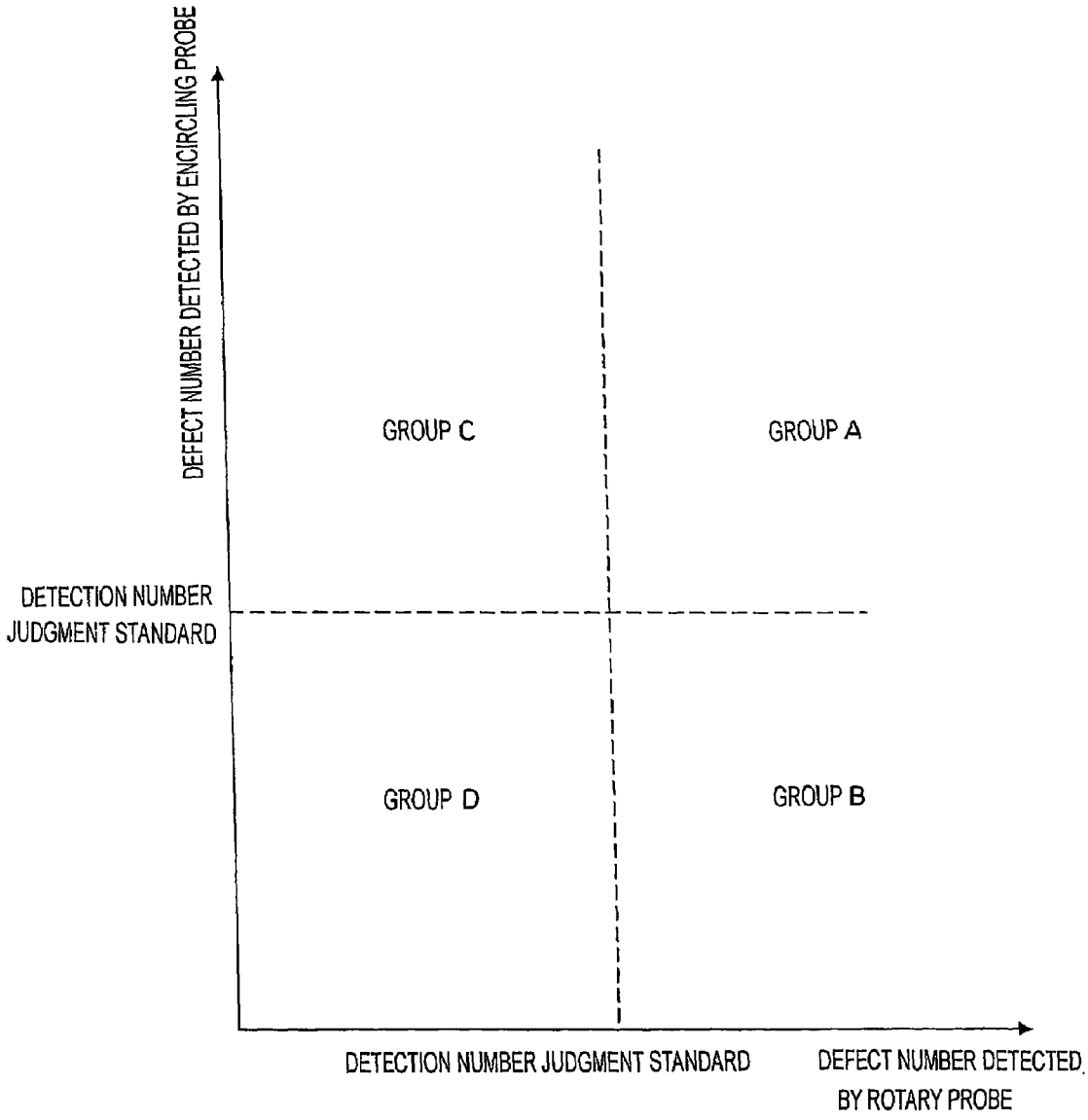
FIG. 27 is an explanatory view showing groups of defects detected with the encircling eddy-current flaw detection apparatus and rotary eddy-current flaw detection apparatus shown in FIG. 23.

FIG. 27 is an explanatory view showing groups of defects detected by the encircling eddy-current detection apparatus 1420 and the rotary eddy-current detection apparatus 1430. The encircling probe of the encircling eddy-current detection apparatus 1420 constituting the first nondestructive inspection apparatus 1410 and the rotary probe of the rotary eddy-current detection apparatus 1430 have their respective sensitivity calibrated beforehand and the defect detection judgment standard and a defect detection number judgment standard set respectively. The defect numbers detected by the encircling probe and rotary probe are compared with the corresponding defect detection number judgment standards to obtain classifiable groups. As shown in FIG. 27, for example, classified groups are group A (the defect number detected by the encircling probe is higher than the defect detection number judgment standard, and the defect number detected by the rotary probe is higher than the defect detection number judgment standard), group B (the defect number detected by the encircling probe is lower than the defect detection number judgment standard, and the defect number detected by the rotary probe is higher than the defect detection number judgment standard), group C (the defect number detected by the encircling probe is higher than the defect detection number judgment standard, and the defect number detected by the rotary probe is lower than the defect detection number judgment standard) and group D (the defect number detected by the encircling probe is lower than the defect detection number judgment standard, and the defect number detected by the rotary probe is lower than the defect detection number judgment standard). A group judgment standard is given to the detected number of workpieces (test pieces, continuously cast aluminum alloy rods) 4001 classified into four groups A to D to compare the number with the standard, thereby judging what the defect-rich group is. It is noted that each of the defect detection number judgment standard and the group judgment standard may be set to a multi-step standard, when necessary.

The groups A to D are classified in terms of the shape and kind of flaws. An encircling probe can detect the surface of a workpiece in the circumferential direction with high precision and, in comparison with the rotary probe, is excellent in ability of detection of foreign matter on the workpiece surface or in the workpiece. In contrast, the rotary probe can detect minute opening defects with high precision and, in comparison with the encircling probe, excellent in ability of detection of defects of the workpiece surface in the longitudinal direction. Therefore, the groups A to D are classified also in terms of the orientation of defect shapes and the presence or absence of foreign matter. Since these defects are influenced by any of the manufacturing steps, the states of generation of the classified defects are reflected by the states of the manufacturing steps.

A stable manufacturing method is attained through feedback of the manufacturing conditions. Specifically, a feedback of the casting conditions is performed when the casting surface state is reflected, and that of the working conditions is performed when the mechanical processing state is reflected.

To be concrete, a feedback operation after judgment is performed in the following manner. When there are lots of workpieces classified into group A (the defect number detected by the encircling probe is higher than the defect detection number judgment standard, and the defect number detected by the rotary probe is higher than the defect detection number judgment standard), this indicates a great number of large opening defects on the surface of the workpiece. The defects of this kind occur increasingly when the casting surface is greatly rugged. Since the defects of this state frequently occurs at the casting step, it is effective that a feedback F3 of casting conditions to the continuously casting apparatus 301 is performed as shown in FIG. 23. In brief, since there is a possibility of the amounts of the lubricant and gas supplied in the casting process being inappropriate, for example, the amounts are adjusted to appropriate amounts. Otherwise, inspection and repair in mechanical state of the continuously cast apparatus 301 are performed. The portions to be inspected are the operation speeds of the synchronous clamp mechanism 402 (FIG. 7) and cutting mechanism 401 (FIG. 7), the pinching force exerted on the ingots from the continuously casting apparatus 301, the vibration-generating circumstances, for example.

When there are a lot of workpieces classified into group B (the defect number detected by the encircling probe is lower than the defect detection number judgment standard, and the defect number detected by the rotary probe is higher than the defect detection number judgment standard), defects occur increasingly in the mechanical working step. The defects increasingly occur, for example, when the state of collision of the cutting blades is inappropriate in the cutting working, when tool marks remain due to insufficient straightening or inversely when roll marks of the straightening apparatus are transferred to mar the surface due to intensive straightening force, and when such projections as marring the surface of the continuously cast aluminum alloy rod are present on the conveying line. Since the defects of this state occur increasingly in the processing steps, it is effective that feedbacks F1 and F2 of mechanical processing conditions to the straightening apparatus 1001 and the peeling apparatus 1101 are performed as shown in FIG. 23. To be concrete, the skin cutting conditions (cutting conditions) and straightening conditions (straightening performed after skin cutting of the continuously cast aluminum alloy rod and before the nondestructive inspection) are adjusted. Otherwise, inspection and repair of mechanical states of the peeling apparatus 1101, straightening apparatus 1001 and conveying line are carried out.

When there are a plenty of workpieces classified into group C (the defect number detected by the encircling probe is higher than the defect detection number judgment standard, and the defect number detected by the rotary probe is lower than the defect detection number judgment standard), the defects occur increasingly on the surface of the workpiece in the circumferential direction. The defects of this kind occur increasingly in the presence of seizure, oxide and entangling of refractory material constituting the casting die. The defects of this state are due to the presence of foreign matter and occur in the melting and casting steps. Therefore, feedback of the molten-metal treatment conditions to the molten-metal treatment apparatus 201 and feedback of the casting conditions to the continuously casting apparatus 301, as shown by feedbacks F3 and F4 in FIG. 23, are effective. Examples of the feedback operation of the molten-metal treatment conditions are the adjustment of the flow rate of the inert gas to be used, the adjustment of the rpm of the stirring member, the inspection of the deterioration state of the stirring member and the inspection of gas leakage. An example of the feedback operation of the casting conditions is the adjustment of the amounts of the lubricant and gas to their respectively appropriate amounts because excess amounts are causes of these defects.

Preferably, the ultrasonic flaw detection result information is taken into consideration. In the case where there are a large number of workpieces classified into group C and where there are a small number of defects as a result of the ultrasonic flaw detection, it can be judged that the horizontally continuously cast aluminum alloy rod is in a sound internal state. Therefore, the adjustment of the casting conditions is mainly carried out. That is to say, the main feedback is the feedback F3. In contrast, in the case where there are a large number of defects as a consequence of the ultrasonic inspection when there are a large number of workpieces classified into group C, it can be judged that there is a fair possibility of foreign matter is contained in the ingot. Therefore, there is a possibility of the molten aluminum alloy being contaminated. That is to say, the adjustment of the molten-metal treatment conditions is principally carried out. In other words, the main feedback is feedback F4.

When there are a great number of workpieces classified into group D (the defect number detected by the encircling probe is lower than the defect detection number judgment standard, and the defect number detected by the rotary probe is lower than the defect detection number judgment standard), it can be judged that the quality conditions are satisfied.

The inspection signal frequency (coil excitation frequency) of the encircling probe can be at a high-frequency channel (10 kHz to 100 kHz, preferably 20 kHz to 50 kHz) or a low-frequency channel (1 kHz to 10 kHz, preferably 1.5 kHz to 5 kHz) using a double frequency. On the other hand, the inspection signal frequency of the rotary probe can be 100 kHz to 1,000 kHz (preferably 300 kHz to 700 kHz). Here, important is the relation (encircling probe frequency)<(rotary probe frequency). This is because the rotary probe can efficiently utilize its characteristic that detects minute surface flaw with high precision when the detection frequency of the rotary probe is set higher than that of the encircling probe. On the other hand, the detection frequency of the encircling probe is preferably set lower than that of the rotary probe, but set so as to enable detection of slightly depth portion from the surface to cover a dead zone of the ultrasonic waves.

Use of this detection method enables multi-dimensional analysis of the defect information and consequently facilitation of assumption of manufacturing step circumstances based on the defect information and feedbacks of the assumed circumstances to the manufacturing steps, resulting in manufacture of cast rods stable in quality.

The embodiments exemplify horizontally continuously cast aluminum alloy rods as continuously cast aluminum alloy rods. However, it goes without saying that the continuously cast aluminum alloy rods are not limited to the horizontally continuously cast aluminum alloy rods, and other continuously cast aluminum alloy rods can be adopted.

Among the horizontally continuously cast aluminum alloy rods 4 that have undergone nondestructive inspection as described above, those that are free of internal and surface defects and thus are judged non-defective must be delivered and packed. Preferably, the horizontally continuously cast aluminum alloy rods 4 that have been judged defective in nondestructive inspection are removed from a conveyance line by means of a predetermined ejection or removing apparatus, cut into pieces each having a predetermined size and conveyed back to the melting step.

Figure 22:
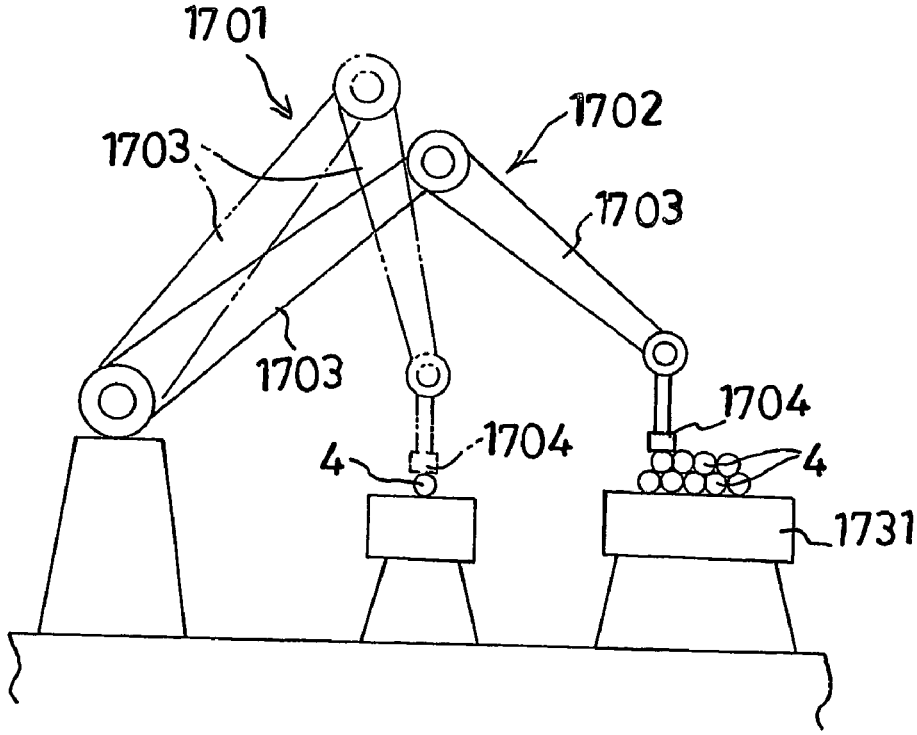
FIG. 22 is a side view of a transfer robot of a packing apparatus.

FIG. 22 is a side view of a transfer robot of the packing apparatus 1701. In FIG. 22, the packing apparatus 1701 includes a transfer robot 1702, a stacking mechanism 1731, such as a conveyor, for stacking in predetermined layers the horizontally continuously cast aluminum alloy rods 4 that have been transferred thereto by the transfer robot 1702 and a packing mechanism 1451 (not shown in this figure) for packing a stack of the horizontally continuously cast aluminum alloy rods 4 on the stacking mechanism 1731. The transfer robot 1702 is, for example, three-articulated. Three arms 1703 are pivotally movable, and one of them is movable in a vertical plane. A plurality of vacuum disks 1704 are provided at the distal end of the one arm 1703 and arranged along a straight line perpendicular to the plane of pivotal movement of the arms 1703. The vacuum disks 1704 can vacuum-attract a single horizontally continuously cast aluminum alloy rod 4 and can release the single horizontally continuously cast aluminum alloy rod 4 by breaking vacuum.

Next, the operation of the packing apparatus 1701 will be described. First, the horizontally continuously cast aluminum alloy rods 4 that are conveyed one by one on a longitudinal-conveyance conveyor and caused to stop at a predetermined position by a stopper. Then, the arms 1703 are moved, for example, as represented by the two-dots-and-dash line of FIG. 22, so as to vacuum-attract, by means of the vacuum disks 1704, the horizontally continuously cast aluminum alloy rod 4 that is stopped at the predetermined position by the stopper. Next, the vacuum disks 1704 are caused to hold the horizontally continuously cast aluminum alloy rod 4. Subsequently, the arms 1703 are moved as represented by the solid line of FIG. 22 so as to transfer the horizontally continuously cast aluminum alloy rod 4 to the stacking mechanism 1731 and place the horizontally continuously cast aluminum alloy rod 4 in a stacking manner on the stacking mechanism 1731. When a predetermined number of the horizontally continuously cast aluminum alloy rods 4 are stacked in a predetermined number of layers, the packing mechanism 1751 (not shown in FIG. 22) binds the stack of the horizontally continuously cast aluminum alloy rods 4 at several longitudinal positions by means of tie bands. The thus bound stack of the horizontally continuously cast aluminum alloy rods 4 is delivered as a product.

Stacking the horizontally continuously cast aluminum alloy rods 4 having a bend of 0.5 mm/1,000 mm by means of the transfer robot 1702 allows stacking in any shape and can suppress occurrence of scratching on rod surface. Packing by means of the packing mechanism 1751 can provide a constant binding force, whereby occurrence of a stack shift can be prevented. The stacking mechanism 1731 may assume a configuration similar to that of the stacking mechanism 610 of the binding apparatus 601.

Next, a horizontally continuously cast aluminum alloy rod 4 to be manufactured as described above will be described. The horizontally continuously cast aluminum alloy rod 4 can have a diameter ranging from 20 mm to 100 mm. The horizontally continuously cast aluminum alloy rod 4 can have a diameter falling outside the above-mentioned range. However, preferably, a diameter of 20 mm to 100 mm is imparted to the horizontally continuously cast aluminum alloy rod 4 since equipment in a later step of plastic working, such as forging, roll forging, drawing, rolling or impact working, is reduced in size and cost. The continuously cast aluminum alloy rod 4 that has undergone cutting of a casting surface portion effected by the peeling apparatus 1101 has a surface roughness Rmax of 100 μm or less and has no cutting mark (peeling mark) on its surface. The "cutting mark (peeling mark)" used herein refers to scratches formed due to entangling of generated chips in the cutting implements, such as a cutting tool, used in the peeling apparatus 1101.

INDUSTRIAL APPLICABILITY

As described above, the method or equipment for manufacturing horizontally continuously cast aluminum alloy rods according to the present invention can efficiently manufacture horizontally continuously cast aluminum alloy rods having consistent quality. Also, high-quality, horizontally continuously cast aluminum alloy rods having a casting surface portion removed efficiently can efficiently be manufactured.

Horizontally continuously cast aluminum alloy rods of the present invention exhibit excellent mechanical properties and enhanced wear resistance.

The invention claimed is:

1. A method for manufacturing horizontally continuously cast aluminum alloy rods, comprising:

a melting step of melting raw material for aluminum alloy to produce molten aluminum alloy;

a molten-metal treatment step of removing aluminum oxide and hydrogen gas from the molten aluminum alloy received from the melting step;

a horizontally continuously casting step of casting the molten aluminum alloy received from the molten-metal treatment step into horizontally continuously cast aluminum alloy rods;

a cutting step of cutting to a standard length the horizontally continuously cast aluminum alloy rods cast in the horizontally continuously casting step;

a conveying step of conveying the cut, horizontally continuously cast aluminum alloy rods;

a first straightening step of straightening bend of the conveyed, horizontally continuously cast aluminum alloy rods;

a peeling step of peeling skin portions of the straightened, horizontally continuously cast aluminum alloy rods;

a nondestructive inspection step of inspecting surface and internal portions of the horizontally continuously cast aluminum alloy rods having the casting surface portions peeled;

a sorting step of sorting horizontally continuously cast aluminum alloy rods judged non-defective based on results of the nondestructive inspection step; and a packing step of packing the horizontally continuously cast aluminum alloy rods judged non-defective, with all steps being continuously performed.

2. The method according to claim 1, wherein an average temperature drop rate of the molten aluminum alloy is set to 15% or lower as measured between the melting step and the horizontally continuously casting step.

3. The method according to claim 1 or claim 2, wherein, in the melting step, tapping from a melting/holding furnace to the molten-metal treatment step is performed by a drop tapping method in which a surface of molten metal to be tapped is higher in level than a surface of tapped molten metal, or by a level-feed tapping method in which the surface of molten metal to be tapped is continuously connected to the surface of tapped molten metal.

4. The method according to claim 1 or 2, wherein the melting step uses a plurality of melting/holding furnaces arranged in parallel in association with the molten-metal treatment step.

5. The method according to claim 1 or 2, wherein, in the cutting step, at least one casting line in the horizontally continuously casting step is capable of being restarted.

6. The method according to claim 1, further comprises a heat treatment step of heat-treating the horizontally continuously cast aluminum alloy rods between the cutting step and the nondestructive inspection step.

7. The method according to claim 1, further comprises, between the conveying step and the first straightening step, an arraying step of arraying the horizontally continuously cast aluminum alloy rods by a conveyance method that combines conveyance of the rods in a lateral direction and conveyance of the rods in a longitudinal direction.

8. The method according to claim 1, wherein the nondestructive inspection step comprises a first nondestructive inspection step for surface inspection to control cutting conditions of the peeling step based on results of the first nondestructive inspection step and a second nondestructive inspection step for internal inspection to control casting conditions of the continuously casting step based on results of the second nondestructive inspection step.

9. The method according to claim 8, wherein the first nondestructive inspection step is performed by at least one method selected from among an eddy-current inspection method for detecting a surface defect of a horizontally continuously cast aluminum alloy rod by use of eddy current, an image-processing inspection method for detecting a surface defect of a horizontally continuously cast aluminum alloy rod and a visual inspection method for visually detecting a surface defect of a horizontally continuously cast aluminum alloy rod, and the second nondestructive inspection step is performed by at least one method selected from among an X-ray inspection method for detecting an internal defect of a horizontally continuously cast aluminum alloy rod by use of X-rays and an ultrasonic inspection method for detecting an internal defect of a horizontally continuously cast aluminum alloy rod by use of ultrasonic waves.

10. The method according to claim 1, wherein the nondestructive inspection step combines internal inspection and surface inspection, the internal inspection is performed by at least one method selected from an X-ray inspection method for detecting an internal defect of a horizontally continuously cast aluminum alloy rod by use of X-rays and an ultrasonic inspection method for detecting an internal defect of a horizontally continuously cast aluminum alloy rod by use of ultrasonic waves, and the surface inspection is performed by at least one method selected from among an eddy-current inspection method for detecting a surface defect of a horizontally continuously cast aluminum alloy rod by use of eddy current, an image-processing inspection method for detecting a surface defect of a horizontally continuously cast aluminum alloy rod by means of processing an image of a surface of the horizontally continuously cast aluminum alloy rod, and a visual inspection method for visually detecting a surface defect of a horizontally continuously cast aluminum alloy rod.

11. The method according to claim 1, wherein the nondestructive inspection step comprises a first nondestructive inspection step for inspecting surface portions of horizontally continuously cast aluminum alloy rods and a second nondestructive inspection step for inspecting internal portions of the rods, in which the first nondestructive inspection step comprises an encircling eddy-current flaw detection step to pass the rods through a probe and a rotary eddy-current flaw detection step to rotate the probe in a circumferential direction of the rods, and further comprising a control step that comprises comparing a number of defects detected at the encircling eddy-current flaw detection step and the rotary eddy-current flaw detection step with a detection number judgment standard to obtain defect distribution groups, comparing the number of defects in each of the defect distribution groups with a group judgment standard to obtain groups exceeding the group judgment standard and controlling, based on the groups exceeding the group judgment standard, molten-metal treatment conditions at the molten-metal treatment step, casting conditions at the horizontally continuously casting step and cutting conditions at the cutting step.

12. The method according to claim 1, wherein the nondestructive inspection step comprises a first nondestructive inspection step for inspecting surface portions of horizontally continuously cast aluminum alloy rods and a second nondestructive inspection step for inspecting internal portions of the rods, in which the first nondestructive inspection step comprises an encircling eddy-current flaw detection step to pass the rods through a probe and a rotary eddy-current flaw detection step to rotate the probe in a circumferential direction of the rods, and further comprising a control step comparing a number of defects detected at the encircling eddy-current flaw detection step and the rotary eddy-current flaw detection step with a detection number judgment standard to obtain defect distribution groups, comparing the number of defects in each of the defect distribution groups with a group judgment standard to obtain groups exceeding the group judgment standard and controlling, based on the groups exceeding the group judgment standard, straightening conditions at the first straightening step.

13. The method according to claim 6, further comprising a binding step of binding the horizontally continuously cast aluminum alloy rods before the heat treatment step and an unbinding step of unbinding the bound rods after the heat treatment step.

14. The method according to claim 1, further comprising a binding step of binding the horizontally continuously cast aluminum alloy rods before the heat treatment step.

15. The method according to claim 14, wherein the horizontally continuously cast aluminum alloy rods are stacked while supporting only opposite end portions of the rods.

16. The method according to claim 1, wherein the conveying step has a retention function for temporarily retaining the horizontally continuously cast aluminum alloy rods.

17. The method according to claim 16, wherein the retention function is such that the horizontally continuously cast aluminum alloy rods are conveyed laterally.

18. The method according to claim 1 or claim 6, wherein the conveying step uses a slat conveyor.

* * * * *